US005679013A

United States Patent [19]

Matsunaga et al.

[11] Patent Number: 5,679,013

[45] Date of Patent: Oct. 21, 1997

[54] ELECTRICAL CONNECTOR AND AN ELECTRONIC APPARATUS USING THE ELECTRICAL CONNECTOR

[75] Inventors: Katsuya Matsunaga, Yamato; Katsuhisa Yamamoto, Yokohama; Akihito Shichida, Yao, all of Japan

[73] Assignees: International Business Machines Corporation, Armonk, N.Y.; Ricoh Company, Ltd., Tokyo; Hosiden Corporation, Osaka, both of Japan

[21] Appl. No.: 519,720

[22] Filed: Aug. 28, 1995

[30] Foreign Application Priority Data

Nov. 14, 1994 [JP] Japan ..... 6-279510

[51] Int. Cl.[6] ..... H01R 13/44

[52] U.S. Cl. ..... 439/144; 439/946; 439/676

[58] Field of Search ..... 439/676, 344, 439/946, 142, 144, 131

[56] References Cited

U.S. PATENT DOCUMENTS

| | | | |
|---|---|---|---|
| 5,336,099 | 8/1994 | Aldous et al. | 439/131 |
| 5,338,210 | 8/1994 | Beckham et al. | 439/946 |
| 5,385,479 | 1/1995 | Okada | 439/144 |
| 5,411,405 | 5/1995 | McDaniels et al. | 439/131 |
| 5,562,472 | 10/1996 | Dubois et al. | 439/676 |

*Primary Examiner*—Neil Abrams
*Assistant Examiner*—Brian J. Biggi
*Attorney, Agent, or Firm*—Jones, Tullar & Cooper, P.C.

[57] ABSTRACT

An open/close type connector having a base member, a cover member, and an electronic apparatus of a card type or a personal computer type using the connector. The connector is thin so that when it is not used, i.e., is not connected with a modular plug the portability of the card is not lost. In addition, less restriction is introduced on the attachment position at which the connector is attached to the card or the personal computer. A link is used for opening and closing the cover member. Structure for enhancing the stability and the electrical connection reliability when a modular plug is mounted on the connector is provided, and the base member and the cover member are adapted to be rotatable so that they can be relatively opened or closed thereby yielding a connector which can be preferably adopted by an electronic apparatus of a card type.

26 Claims, 31 Drawing Sheets

A
C
C1
32
19
22
2
26
140
27
28
130
21
151
110
100
120
150
3
12b
12
12a
31
1
13b
17
13a
13
15

ELECTRICAL CONNECTOR AND AN ELECTRONIC APPARATUS USING THE ELECTRICAL CONNECTOR

BACKGROUND OF THE INVENTION

1. Field of the Invention

The present invention relates to a jack-type electrical connector through which a communications modular plug is connected to a card with superior portability such as a thin modem card, or a communications modular plug is connected to a personal computer, and also to an electronic apparatus such as the above-mentioned card and personal computer using the electrical connector.

2. Description of the Prior Art

As a versatile communications modular plug, known is a modular plug shown in FIG. 36 which is frequently used for connecting telephone lines. The modular plug comprises a connector body 110 having a rectangular parallelopiped shape, a protruding portion 120 extending over a front end corner portion of the connector body 110, an arm portion 130 which has resiliency and extends from the protruding portion 120 to the back end portion along the connector body 110, and step-like engagement portions 140, 140 (only one of the engagement portions 140 is shown in the figure) provided on both side faces of the arm portion 130. Terminals 150, . . . connected to a signal line 151 are exposed in another front end corner portion of the connector body 110.

As a counter connector for the communications modular plug shown in FIG. 36, a modular jack for a telephone line which is frequently used for connecting an indoor line to a telephone set is known. As the modular jack, there has conventionally existed a modular jack in which parts such as terminals (electrodes) are simply housed in a case. However, this modular jack cannot prevent a human body from touching the terminals, and dust and dirt from attaching to the terminals.

As a modular jack which can solve the noted problem, a modular jack shown in FIG. 37 is known. In the modular jack shown in FIG. 37, a lid 220 is attached via a horizontal shaft 221 to an aperture 210 of a case 200 which houses terminals and the like. In the modular jack, when not in use, the lid 220 is closed as shown by the phantom lines, so that the human body is prevented from touching the terminals, and dust and dirt are prevented from attaching to the terminals. When in use, the lid 220 is opened as indicated by the solid lines, and the modular plug 100 is inserted and connected to the case 200.

On the other hand, various types of personal computers such as a portable type, and a note type have recently been used. In addition, communications by means of using such personal computers as a medium have also been variously developed. In such a situation, attempts have been made such as that the modular plug 100 is connected to a card such as a modem card which is inserted into a slot of a personal computer, and that the modular plug 100 is directly connected to the personal computer. Various connection systems have been hitherto proposed for the attempts.

In a connection system, such as shown in FIG. 38, a cable 300 which is connected to an adapter 310 having a size larger than that of the modular plug 100 is connected to a card C such as a PCMCIA card (a card recommended by Personal Computer Memory Card International Association) which is inserted into a slot S of a personal computer PC, and the whole of the modular plug 100 is inserted and connected to the adapter 310.

In a connection system, such as shown in FIG. 39, a modular jack J is retractably attached to a card C. When in use, the modular plug 100 is vertically inserted into an entry K of the modular jack J protruding from the card C, thereby accomplishing the connection. A modular jack J of this type includes, for example, a modular jack for a modem card referred to as an X-JACK produced by Megahertz Corporation. In some cases, the direction of inserting the card C into the slot of a personal computer is prefixed. In such cases, as shown in FIG. 40, the modular plug 100 may be impelled to be inserted from the lower side into the entry K of the modular jack J protruding from the card C.

In a connection system such as shown in FIG. 41, a modular jack J is retractably attached to a casing of a personal computer PC. As shown in FIG. 42, the modular plug 100 is vertically inserted into an entry K of the modular jack J protruding from the personal computer PC, thereby accomplishing the connection.

However, the above-mentioned connection systems involve the following problems.

(1) In the systems using the modular jack described with reference to FIG. 37, it is necessary for the case 200 to have a size which can accommodate the whole of the modular plug 100. Accordingly, if the modular jack is to be attached to a thin card or a casing of a personal computer, the portability of the card is lost, and the attachment position in the personal computer is largely limited.

(2) In the connection system described with reference to FIG. 38, the adapter 310 and the cable 300 are additionally required. Moreover, since it is necessary to ensure a setting space for the adapter 310 on a disk or the like, there arises a disadvantage in terms of space.

(3) In the connection systems described with reference to FIGS. 39 and 40, the terminals of the modular jack J are completely exposed when in use. In the case of handling a high voltage, there are electric shock hazards. The same problem may arise also in the connection systems described with reference to FIGS. 41 and 42. In addition, another problem arises when the system is applied to a personal computer PC having two slots S1 and S2 as upper and lower slots as shown in FIG. 43. For example, in the case where a cable (SCSI cable) 300 falling within SCSI (Small Computer System Interface) standards is connected to a card C' which is inserted into the lower slot S1, and the modular plug 100 is connected to the modular jack J of the card C which is inserted into the upper slot S2, the modular plug 100 protruding from the modular jack J interferes with the SCSI cable 300 of the card C' inserted into the lower slot S1, as shown in FIG. 44. Accordingly, they cannot be practically used.

(4) If the connection system described with reference to FIG. 40 is adopted, it is difficult to ensure a sufficiently large space under the modular jack J. Accordingly, the personal computer PC is not securely set on the desk face, or the signal line 151 connected to the modular plug 100 is bent and may be easily broken. Also in the case where the connection systems described with reference to FIGS. 41 and 42 is adopted, the same problem may arise.

SUMMARY OF THE INVENTION

The present invention has been developed with a view to the above-described prior art and problems. The fundamental concept of the present invention is to provide an electrical connector comprising a base member and a cover member for opening or closing an aperture of the base member, and an electronic apparatus of a card type and a personal computer type using such a connector.

In the following description, the term "connector" means an electrical connector, and the term "counter connector" means a counter electrical connector.

It is an object of the present invention to provide a connector by which, when the connector is attached to a card, the portability of the card is not lost, and, when the connector is to be attached to a personal computer, less restriction on an attachment position is introduced, and to provide an electronic apparatus of a card type or a personal computer type using such a connector.

It is another object of the present invention to provide a connector in which, when not in use or when the counter connector is not connected, a terminal is completely covered by a cover member, whereby electric shock hazards when a human body touches the terminal can be eliminated, and to provide an electronic apparatus of a card type or a personal computer type using such a connector.

It is a further object of the present invention to provide a connector in which, when not in use, dust or dirt may not be attached to the terminal, and to provide an electronic apparatus of a card type or a personal computer type using such a connector.

It is a still further object of the present invention to provide a connector by which a plug such as a modular plug can be connected to a card or a personal computer without requiring additional components such as an adapter and a cable, and to provide an electronic apparatus of a card type or a personal computer type using such a connector.

It is a still further object of the present invention to provide a connector by which, in any type of personal computer, for example, in a personal computer provided with two slots, i.e., upper and lower slots, a modular plug connected to a card inserted into one of the slots is prevented from interfering with a card inserted into the other slot and a cable elongating therefrom, and to provide an electronic apparatus of a card type or a personal computer type using such a connector.

It is a still further object of the present invention to provide a connector by which conditions where a personal computer is not securely set on a disk face, and where a signal line connected to a modular plug is bent and easily broken can be avoided, and to provide an electronic apparatus of a card type or a personal computer type using such a connector.

Some variants of the invention disclosed in the specification relate to a connector, and the other variants relate to an electronic apparatus using the connector. The electronic apparatus using the connector includes an electronic apparatus of a so-called card type in which the connector is basically attached to a thin card, and an electronic apparatus of a so-called personal computer type in which the connector is basically attached to a personal computer.

Hereinafter, means for solving the problems will be described separately for the connector, the electronic apparatus of a card type, and the electronic apparatus of a personal computer type.

(1) Connector

The connector of the present invention is a connector provided with a base member in which an upper face has an aperture and a cover member for opening and closing the aperture of the base member. The connector comprises: the base member; a receiving face, disposed in the base member, for receiving a counter connector having a rectangular parallelopiped shape; a terminal member, disposed in the base member, for being elastically in contact with a terminal of the counter connector which is received by the receiving face; the cover member pivotally supported by one end portion of the base member to be rotatable to be opened and closed, the cover member and the receiving face of the base member forming an accommodating space for the counter connector when the cover member is opened, the cover member and the receiving face sandwiching the counter connector which is received by the receiving face; an engagement mechanism for being engaged with an engagement portion of the counter connector which is received by the receiving face, thereby preventing the counter connector from slipping out; and an open position restricting mechanism for restricting an open angle of the cover member with respect to the base member.

According to the connector of the present invention, the cover member is closed when not in use, so that the terminal member disposed in the base member is prevented from being touched by a human body. As a result, even in the case where a high voltage is handled, electric shock hazards can be eliminated. In addition, when not in use, i.e., when the cover member is closed, the cover member prevents dust and dirt from attaching to the terminal member disposed in the base member. As a result, the contact reliability and the contact stability between the terminal of the counter connector and the terminal member in the base member when in use are enhanced. Moreover, the open angle of the cover member when in use is restricted by the open position restricting mechanism, and the counter connector which is received by the receiving face is prevented from slipping out by the engagement mechanism, and the counter connector is sandwiched by the receiving face and the cover member. Accordingly, the mounting condition of the counter connector received by the receiving face is stabilized. This is useful for further enhancing contact reliability and contact stability.

In the connector of the present invention, as the open position restricting mechanism, a mechanism using a link can be preferably adopted. In the specification, specific constructions of two kinds of open position restricting mechanisms using a link are proposed.

In one of the constructions, one end portion of a link having a long hole which elongates in a longitudinal direction is rotatably attached to the other end portion of the base member, and a projection disposed on a side face of the cover member is movably fitted into and held by the long hole, when the cover member is in an open position, the projection abuts against an edge portion of the long hole in the other end portion of the link, thereby restricting an open position of the cover member. By constructing the open position restricting mechanism in this way, when the connector is in use, the link is allowed to support the counter connector on both sides thereof, so that it is useful for stabilizing the mounting condition of the counter connector. The link is useful also for enhancing the coupling strength of the base member with the cover member.

In the other construction, one end portion of a link is attached to the cover member in a rotatable manner about an axis which is parallel to a rotation axis of the cover member, and a projection disposed on the other end portion of the link which is accommodated in the base member is movably fitted into and held by a long guide groove. The long guide groove is disposed on a side wall of the base member so as to elongate in a longitudinal direction of the side wall, and the projection abuts against an edge portion of the guide groove when the cover member is in an open position, thereby restricting an opening position of the cover member. By constructing the open position restricting mechanism in this way, in addition to the above-mentioned functions for stabilizing the mounting condition of the counter connector and for enhancing the coupling strength of the base member with the cover member, the link is prevented from being protruding from the cover member or the base member when the cover member and the base member are relatively opened or closed. Accordingly, as apparent from the description of FIGS. 31 to 33 which follows hereinafter, the operability is enhanced, and the connector can be preferably used as a connector of a so-called double openable type.

In the connector of the present invention, a modular plug having the construction illustrated in FIG. 36 can be used as the counter connector. In such a case, as the specific construction of the engagement mechanism, the following mechanism is desirably adopted. That is, a retaining projection is disposed on a back face of the cover member so that, when the counter connector is inserted in the accommodating space between the cover member in the open position and the receiving face of the base member, the retaining projection is engaged with the engagement portion of the counter connector due to recovering deformation of the arm portion which is caused after the engagement portion is pressed and the arm portion is deformed in a direction toward the connector body. By constructing the engagement mechanism in this way, the existing communications modular plug can be used as the counter connector in the same way as in a conventional connector. In this case, it is preferred to adopt the following construction. That is, a recessed portion having a width larger than a horizontal width of the protruding portion of the counter connector is disposed in an edge intermediate portion in the other end portion of the base member, and a protruding piece which protrudes at a position opposite to the recessed portion when the cover member is in a closed position is disposed on the cover member. With this construction, the protruding portion of the modular plug which is the counter connector can be inserted into the recessed portion of the base member, and the protruding piece of the cover member can be pulled up by the protruding portion, whereby operability is further enhanced.

In the connector of the present invention, the base member may comprise an aperture which can accommodate the cover member in a closed position, and a cover member receiving portion which abuts against the cover member when it is closed, thereby restricting a position of the surface of the cover member so that the surface is flush with an end face around the aperture of the base member. By adopting this construction, when the cover member is closed, the cover member is accommodated in the aperture of the base member. Accordingly, the thickness of the connector can be made equal to that of the base member. This is useful for attaining a thin body of the connector.

In the present invention, it is possible to adopt a construction in which the receiving face is formed as a V-shaped groove-like face having a supporting face for supporting the lower face of the counter connector in a rectangular parallelopiped shape and an abutting face for supporting the front face of the counter connector, and the supporting face of the groove-like face is substantially parallel to the back face of the cover member in the open position facing the counter connector. By adopting this construction, the counter connector is inserted in the accommodating space between the receiving face of the base member and the cover member, so as to be sandwiched by the receiving face and the cover member. Accordingly, the mounting condition of the counter connector is stabilized. This is useful for enhancing contact reliability and contact stability between the terminal of the counter connector and the terminal member of the base member. In addition, the supporting face which constitutes the receiving face functions as a guiding face for allowing counter connector to be easily inserted. Accordingly, the operability is increased.

In the present invention, it is possible to adopt a construction in which the cover member is pivotally supported by one end portion of the base member in a rotatable manner to be relatively opened and closed. With this construction, one of opening operations for opening the cover member while the base member is fixed and for opening the base member while the cover member is fixed can be arbitrarily selected. This is useful for increasing operability.

Many other features and effects related to the connector of the present invention will be more apparent by referring to and understanding the descriptions of the embodiments which will be described.

(2) Electronic Apparatus of a Card Type

In the electronic apparatus in the form of a card using a connector according to the present invention, a card such as a modem card comprises the electrical connector, and a recessed portion disposed in the card, the base member of the connector being fixed in the recessed portion.

In the electronic apparatus having the construction described above, the connector constitutes a portion of the card. Since a connector provided with a base member in which an upper face has an aperture, and a cover member is used, the functions of each of the connectors are attained, and the portability of the card can be easily maintained by setting the thickness of the connector within the thickness of the card. Accordingly, it is possible to provide an electronic apparatus to which the counter connector such as a modular plug can be connected without any problems, while the apparatus is thin and superior in portability. Since it is unnecessary to use an adapter, it is also unnecessary to ensure a space for placing the adapter. Thus, it is advantageous in terms of space. In addition, after the cover member of the connector is pulled up and opened by one hand by using the counter connector, the counter connector can be immediately inserted into and connected to the connector. Accordingly, operability is extremely increased.

In the electronic apparatus having the construction described above, if a construction in which the height of the base member is equal to the thickness of the card such as a modem card, and when the base member is accommodated in and held by the recessed portion of the card, the other end portion of the base member is exposed on an end face of the card is adopted, the surface and the back face of the connector when not in use, i.e., in a condition where the cover member is closed can be made flush with the surface and the back face of the card. Accordingly, it is advantageous that the portability of the card is not lost by the connector.

In another electronic apparatus of a card type using a connector according to the present invention, the card such as a modem card comprises: the above-mentioned connector; a recessed portion, formed in the card, for holding the base member of the connector in a retractable manner in a depth direction; an extruding spring member, interposed between the base member and the card, for always urging the base member in a protruding direction from the recessed portion; a first engagement member which is disposed in one end portion of the base member and abuts against a protruding piece which protrudes in a direction across an entrance aperture of the recessed portion of the card when a pivotally supporting portion of the base member and the card member protrudes to the outside of the recessed portion, thereby preventing the base member from slipping out of the recessed portion; an opening spring member, interposed between the cover member and the base member, for always urging the base member in an opening direction; a slide portion which is disposed in the cover member and slides due to a pressure by the protruding piece of the card for opening the cover member in a process in which the cover member is retracted into the recessed portion of the card together with the base member; a second engagement member which is disposed in the cover member and engaged with the protruding piece, thereby preventing the base member from protruding; and a space for allowing the cover member to be pressed into the inner space of the base member by a width which can release the engagement of the second engagement member with the protruding piece of the card.

According to the electronic apparatus having the above-mentioned construction, under the condition in which the base member is retracted in the recessed portion of the card, the card member is pressed into the inner space of the base member, so as to release the engagement of the second engagement member with the protruding piece. As a result, by the force of the extruding spring body, the base member is extracted from the recessed portion of the card together with the cover member to a position at which the first engagement member abuts against the protruding piece. When the cover member is extracted from the recessed portion, the pressing function of the protruding piece against the slide portion of the cover member is no longer exerted. Thus, the cover member is opened by the force of the opening spring member. Accordingly, the counter connector can be inserted in the accommodating space between the receiving face of the base member and the cover member. When the base member which is extracted from the recessed portion of the card is pressed and retracted into the recessed portion against the force of the extruding spring member, the slide portion of the cover is pressed by the protruding piece in the retracting process, so that the open angle is gradually reduced. When the base member is completely retracted, the slide portion is pressed by the protruding piece and the cover member is completely closed. At the same time, after the second engagement member passes through the protruding piece, the second engagement member is returned to the position at which it is engaged with the protruding piece by the force of the opening spring member. According to the electronic apparatus of a card type of the present invention, as will be apparent from the description with reference to FIGS. 31 to 33, the base member or the cover member protrudes from the card only when in use. When not in use, the members can be retracted in the recessed portion of the card. Therefore, the portability of the card is not lost.

In the electronic apparatus of a card type having the above-mentioned construction, it is possible to adopt the construction in which a slide terminal elongating integratedly with the terminal member is led to the outside of one end portion of the base member, and the slide terminal is always elastically in contact with a conductive pattern disposed on the card. With this construction, the slide terminal which is extended integratedly with the terminal member is always elastically in contact with the conductive pattern on the card, so that it is unnecessary to use a flexible wiring board. This is advantageous in that the wiring arrangement can be simplified. This is suitably applied to a connector of a retractable type. In this case, even if the base member protrudes from the recessed portion of the card, the terminal member is always electrically connected to the conductive pattern via the slide terminal.

In a still other electronic apparatus of a card type using a connector according to the present invention, the card such as a modem card comprises: a shaft member for pivotally supporting one end portion of the base member of the above-mentioned connector and a rear end portion of a recessed portion formed in the card, the shaft member being parallel to a rotation axis of the cover member; a base member positioning mechanism which is disposed between the base member and the card and allows the base member to be rotated for ejection to one side of the recessed portion about the shaft member and for preventing the base member from being rotated for ejection to the other side; and a cover member positioning mechanism, disposed between the cover member and the card, for allowing the cover to be rotated for ejection to the other side of the recessed portion about the shaft member and for preventing the cover member from being rotated for ejection to the one side.

According to the electronic apparatus of a card type having the above-mentioned construction, when the base member is rotated for ejection from one side of the recessed portion of the card, the cover member is held in the recessed portion by the cover member positioning mechanism. When the cover member is rotated for ejection from the other side of the recessed portion, the base member is held in the recessed portion by the base member positioning mechanism. Accordingly, the base member and the cover member are not simultaneously rotated for ejection in the same direction. According to the present invention, the ejecting direction of the base member from the recessed portion when the base member is opened is opposite to the ejecting direction from the recessed portion when the cover member is opened, so that it is possible to connect the counter connector by using either one of a free space on the surface side of the card or a free space on the back face side. Accordingly, even in a case where a personal computer has two slots juxtaposed in upper and lower positions, cards can be inserted and used in both slots.

(3) Electronic Apparatus of a Personal Computer Type

An electronic apparatus of a personal computer using a connector according to the present invention comprises apparatuses and devices including a personal computer.

In another electronic apparatus of a personal computer type using a connector according to the present invention, the apparatus comprises: the personal computer including a base unit, in which a number of operation keys are arranged, and a cover unit with a display screen opened and closed with respect to the base unit; and the connector attached to the base unit.

In still another electronic apparatus of a personal computer using a connector according to the present invention, the apparatus comprises: the personal computer including a base unit, in which a number of operation keys are arranged, and a cover unit with a display screen opened and closed with respect to the base unit; a recessed portion disposed in the cover unit; and the connector, the base member of the electrical connector being fitted into and fixed to the recessed portion.

According to the electronic apparatus of such a personal computer type, the connector constitutes a portion of the card, or the base unit or the cover unit of the personal computer. Accordingly, the attachment position of the connector can be selected with few restrictions. Particularly when the connector is attached to the recessed portion of the cover unit of the personal computer, the connector constitutes a portion of the cover member when not in use, so that there is no situation where the connector protrudes from the cover unit and interferes. In addition, the above-described effects of the connector can also be attained.

Many features and effects of the above-described connector and electronic apparatus using the connector can be also apparent from the following description of the referred embodiments.

BRIEF DESCRIPTION OF THE DRAWINGS

FIG. 43 is an explanatory view showing a personal computer provided with two slots, a conventional card, and the like.

DETAILED DESCRIPTION OF THE PREFERRED EMBODIMENTS

Figure 1:
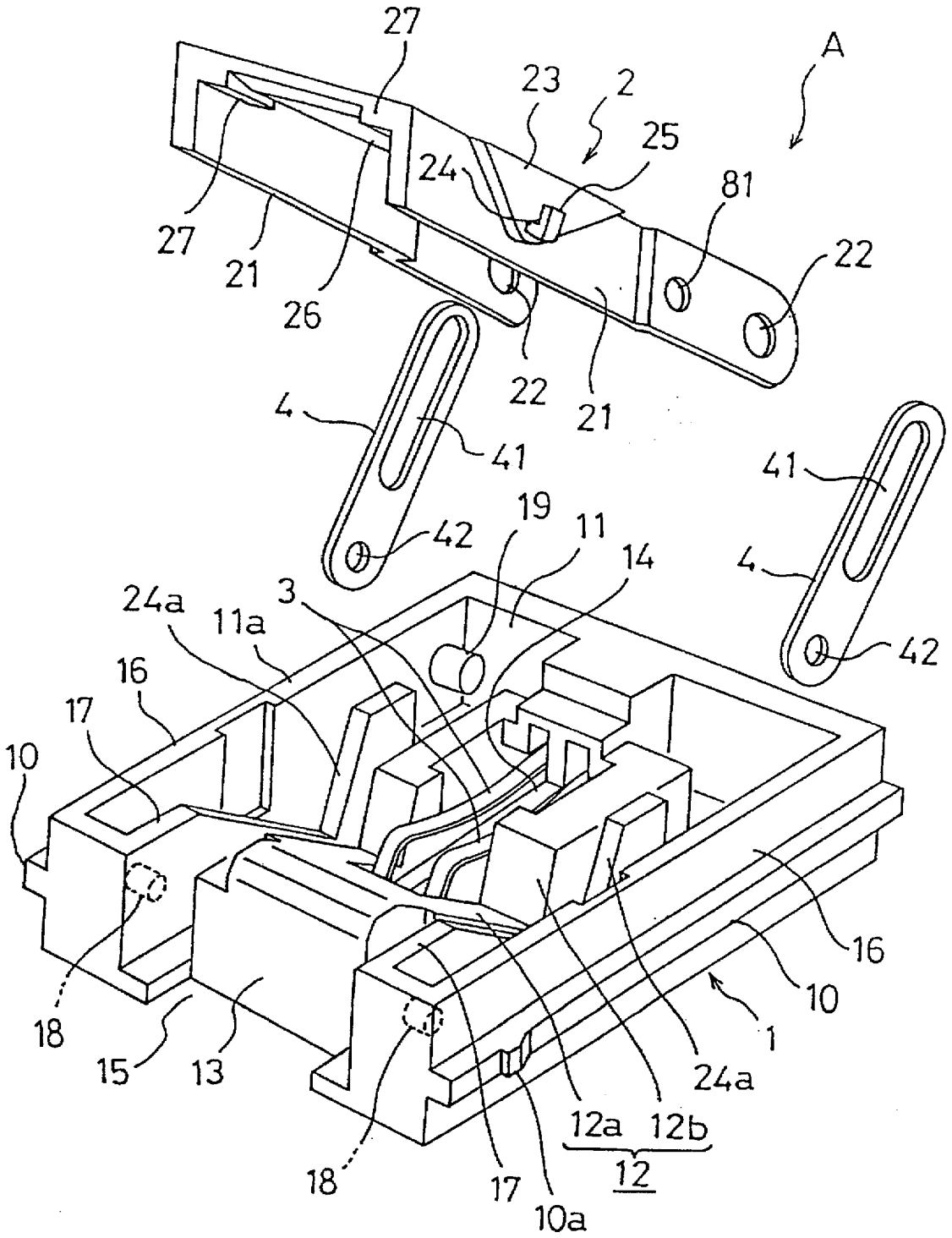
FIG. 1 is an exploded perspective view showing a first embodiment of the connector according to the present invention.

FIG. 1 shows a connector A according to a first embodiment. The reference numeral 1 designates a base member of the connector A, and 2 designates a cover member of the connector A. These members are integratedly molded from an electrically insulating synthetic resin, respectively. The base member 1 is formed so as to have a thin box shape and have the upper face as an aperture 11. A receiving face 12 in the form of a V-shaped groove-like face is disposed inside the base member 1. The V-shaped receiving face 12 is formed in such a manner that a supporting face 12*a* as one slope and an abutting face 12*b* as the other slope meet at right angles.

Figure 12:
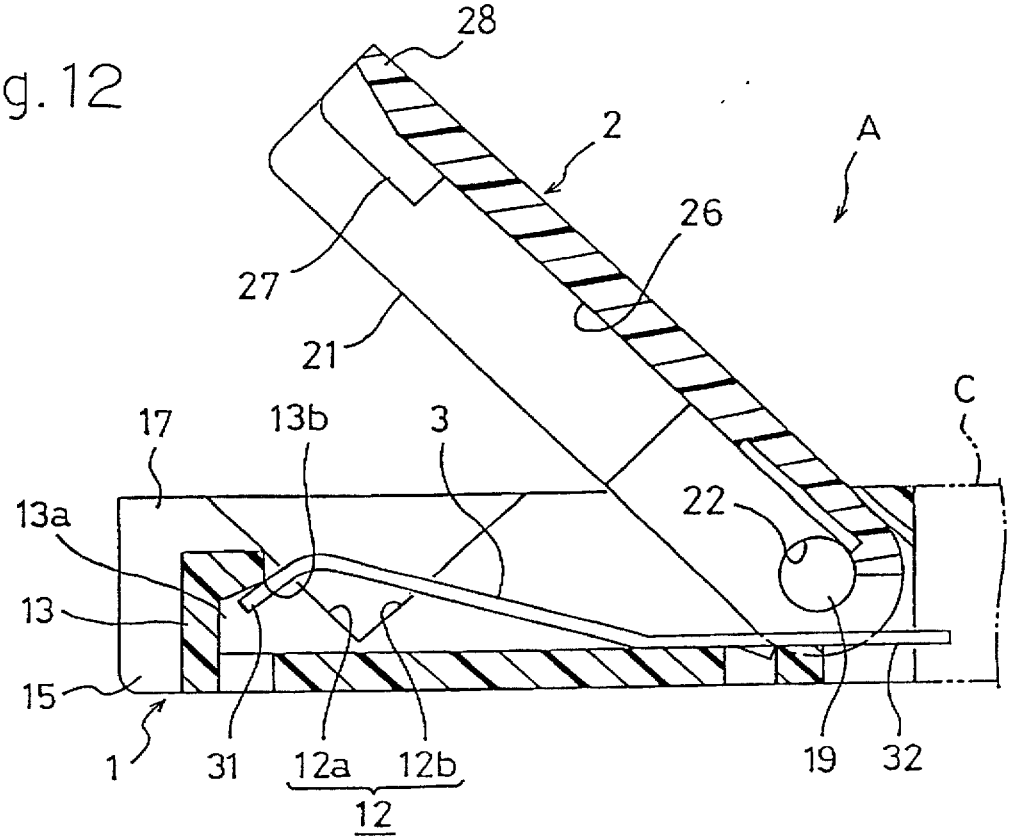
FIG. 12 is a schematic longitudinal side section view showing a condition where the cover member of the connector assembled in the card shown in FIG. 2 or 3 is opened.
Figure 13:
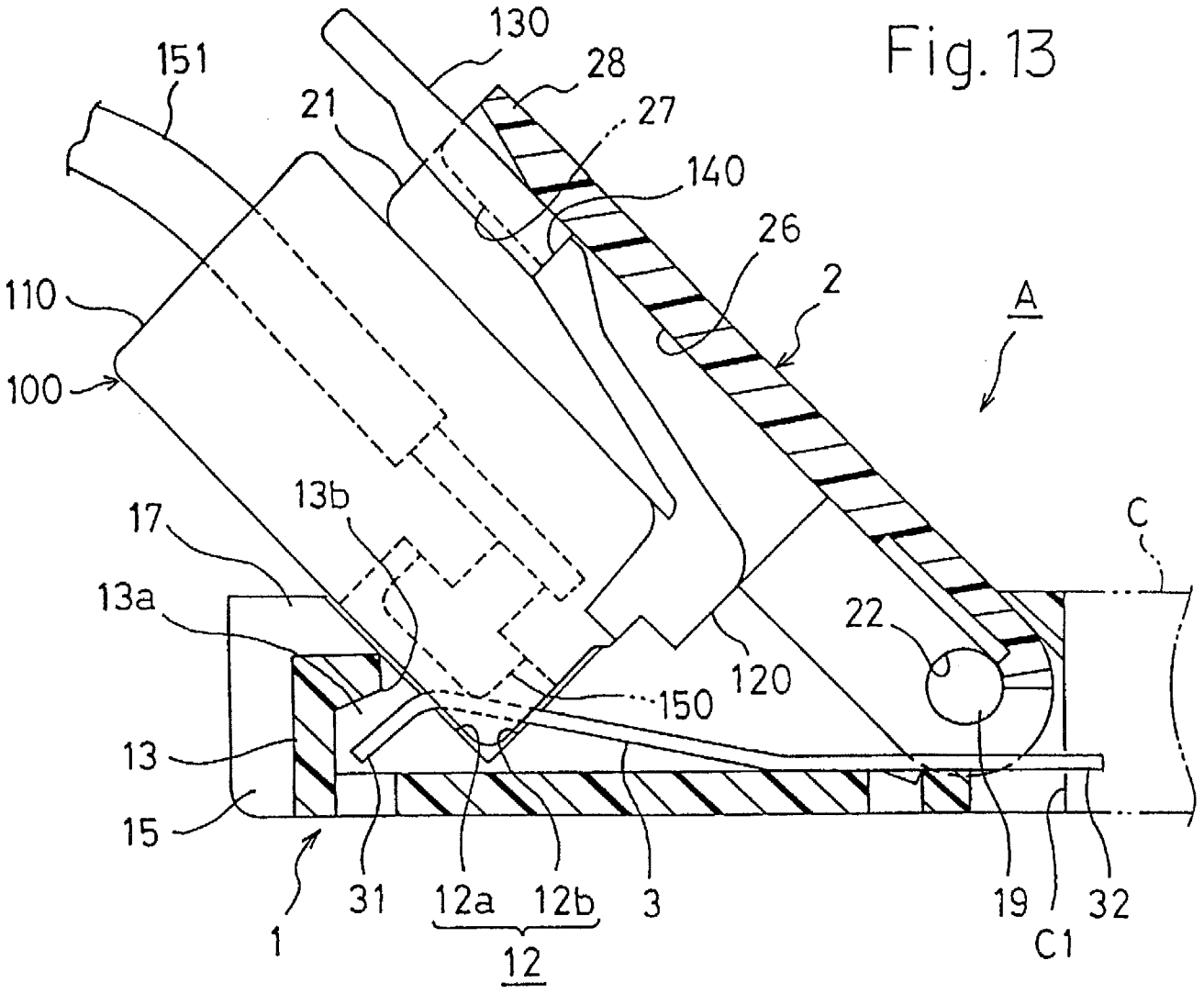
FIG. 13 is a schematic longitudinal side section view showing a condition where a counter connector is connected to a connector assembled in the card shown in FIG. 2 or 3.

As illustrated in FIGS. 12 and 13, the supporting face 12*a* is disposed on an end wall portion 13. In the base member 1, a tip portion 31 of a terminal member 3 which elongates from one end portion (the right side in the figure) to the other end portion (the left side in the figure) is inserted into a recess 13*a* which is formed in the end wall portion 13. The tip portion 31 of the terminal member 3 is engaged with an edge 13*b* of the recess 13*a* while the resilient property of the terminal member 3 itself is maintained. A portion of the terminal member 3 which is in the vicinity of the tip portion 31 is curved so as to form a chevron shape. The connector A is provided with two terminal members 3, and a partition 14 is located between the terminal members 3. The terminal member 3 is led to the outside from one end portion of the base member 1 so as to serve as a connection terminal 32.

As shown in FIG. 1, the end wall portion 13 is disposed at a somewhat secluded position from the other end portion of the base member 1. With this construction, a recessed portion 15 is formed in an edge middle portion in the other end portion of the base member. Between the end wall portion 13, and side walls 16, 16 on both sides of the base member 1, intermediate wall portions 17, 17 are disposed, respectively. In addition, in the other end portion of the base member 1, shafts 18, 18 are protruded from the intermediate wall portions 17, 17 toward the side walls 16, 16. In one end portion of the base member 1, shafts 19, 19 are inwardly protruded from the side walls 16, 16. In FIG. 1, only one of the shafts 19 is shown.

The cover member 2 has circular holes 22, 22 in end portions of wall portions 21, 21 on both sides thereof, respectively. The circular holes 22, 22 are fitted onto the shafts 19, 19, so that the cover member 2 is pivotally supported on the one end portion of the base member 1, whereby the cover member 2 can be freely opened and closed. Triangular thick portions 23, 23 are disposed in portions of the side walls 21, 21 of the cover member 2. V-shaped cover member receiving portions 24*a*, 24*a* are disposed in the intermediate wall portions 17, 17 of the base member 1. When the cover member 2 is closed, the portions 24*a* receive the cover member 2 in a condition where the thick portions 23, 23 are contained. When the cover member 2 is closed and the thick portions 23, 23 abut against the cover member receiving portions 24*a*, 24*a*, the cover member 2 is accommodated in the aperture 11 of the base member 1, and the surface of the cover member 2 is flush with an end face 11*a* around the aperture 11 in the base member 1.

The reference numeral 4 designates a link which has a long hole 41 elongating in a longitudinal direction. A circular hole 42 disposed in one end portion of the link 4 is fitted onto the shaft 18 of the base member 1, whereby the one end portion of the link 4 is pivotally attached to the other end portion of the base member 1. A projection 24 which is protruded from the thick portion 23 of the cover member 2 and provided with a flange portion 25 is movably inserted into the long hole 41. As seen from FIG. 11, when the cover member 2 is in the open position, the projection 24 abuts against the edge portion of the long hole 41 in the other end portion of the link 4, so as to restrict the open position of the cover member 2. Accordingly, the link 4 and the projection 24 constitute the open position restricting mechanism for restricting the open angle of the cover member 2 with respect to the base member 1. As seen from FIGS. 12 and 13, the supporting face 12*a* in the receiving face 12 of the base member 1 is substantially parallel to a back face 26 of the cover member 2 when the cover member 2 is in the open position.

As shown in FIGS. 1, 12, and 13, in the other end portion of the cover member 2, a pair of retaining projections 27, 27 are provided with a space therebetween. The retaining projections 27, 27 are disposed for preventing the plug 100 which is used as the counter connector as described with reference to FIG. 36 from slipping out. The structure of the projection will be described later in detail.

Figure 36:
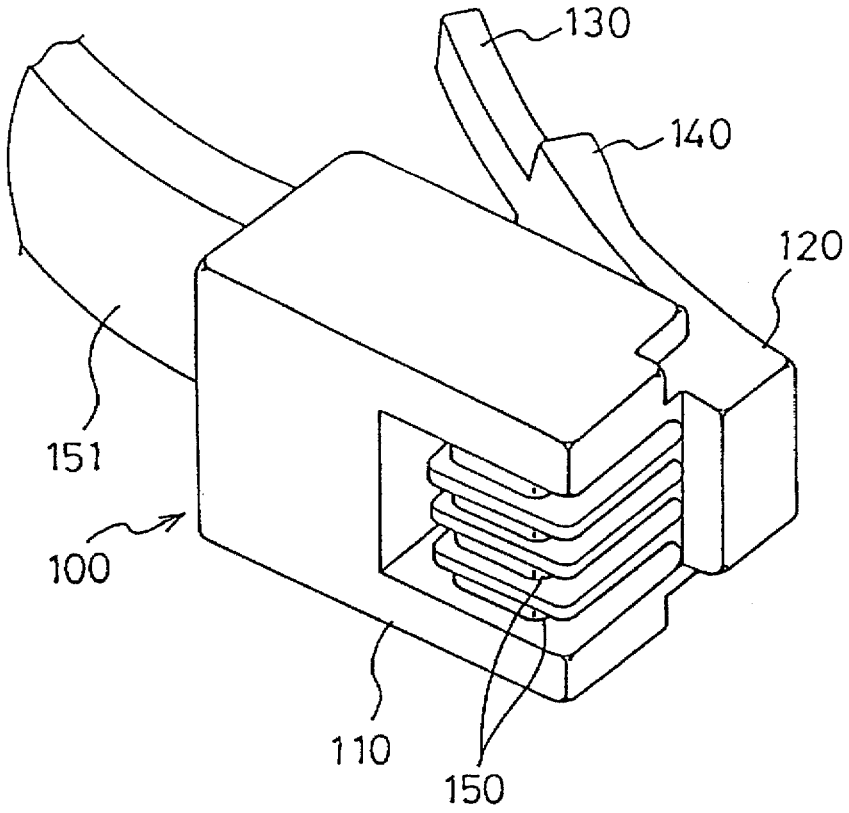
Fig. 36 PRIOR ART
FIG. 36 is a schematic perspective view of a modular plug.
Figure 37:
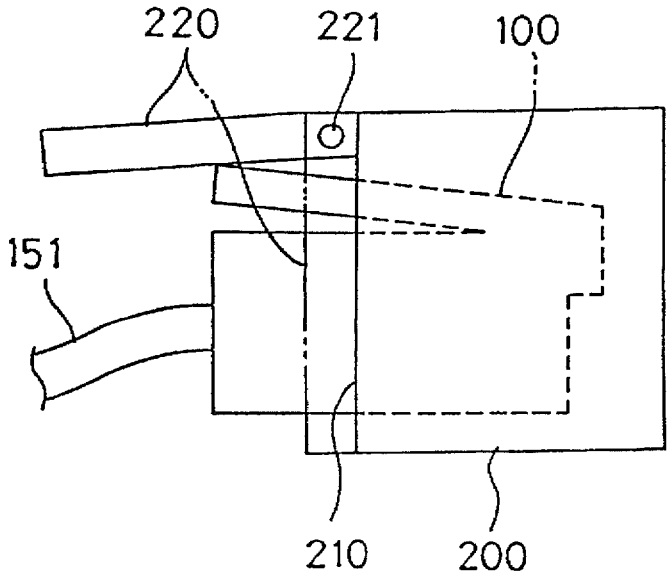
Fig. 37 PRIOR ART
FIG. 37 is an explanatory view of a conventional modular jack.
Figure 38:
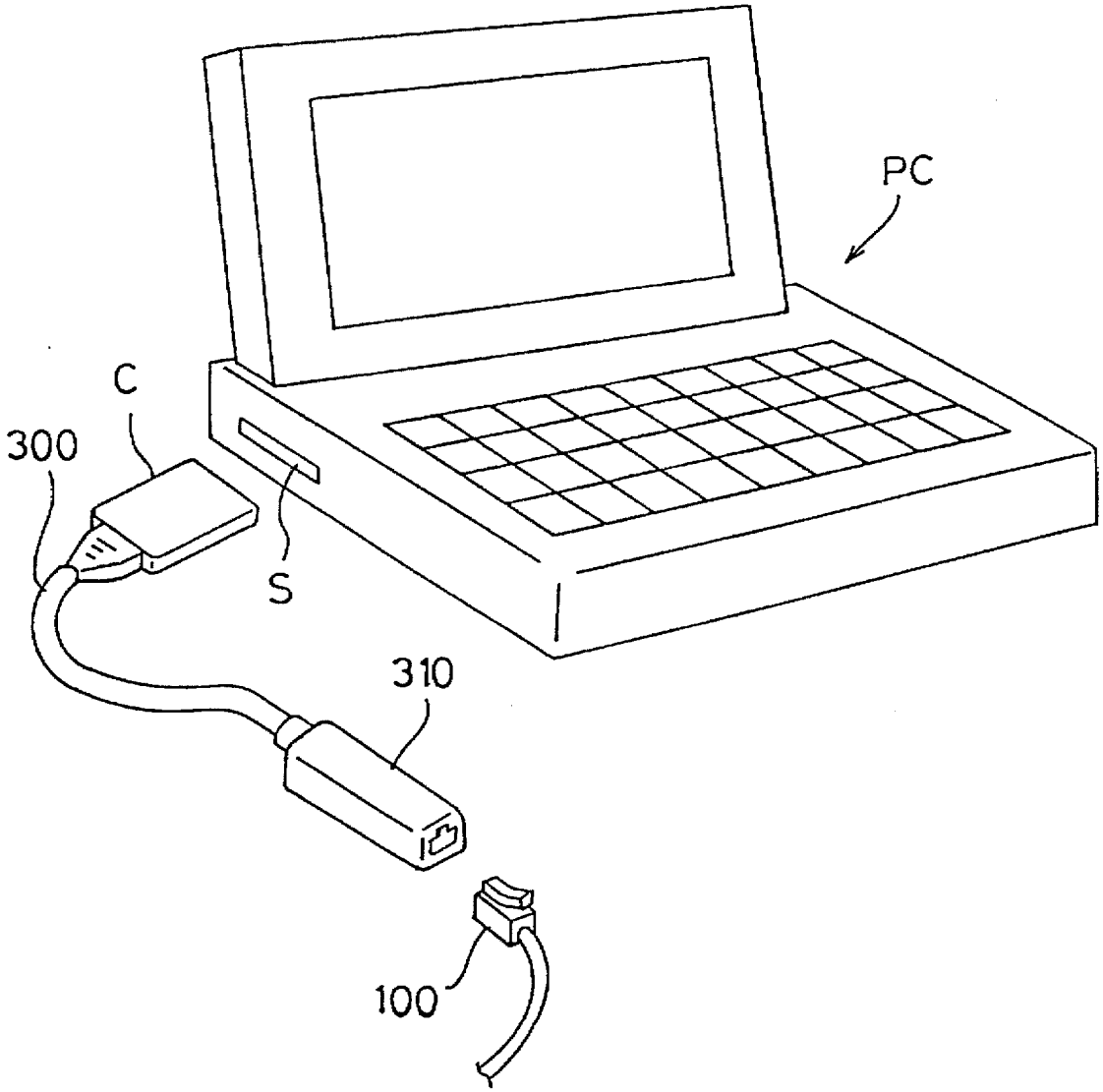
Fig. 38 PRIOR ART
FIG. 38 is an explanatory view of a conventional connection system using an adapter.
Figure 39:
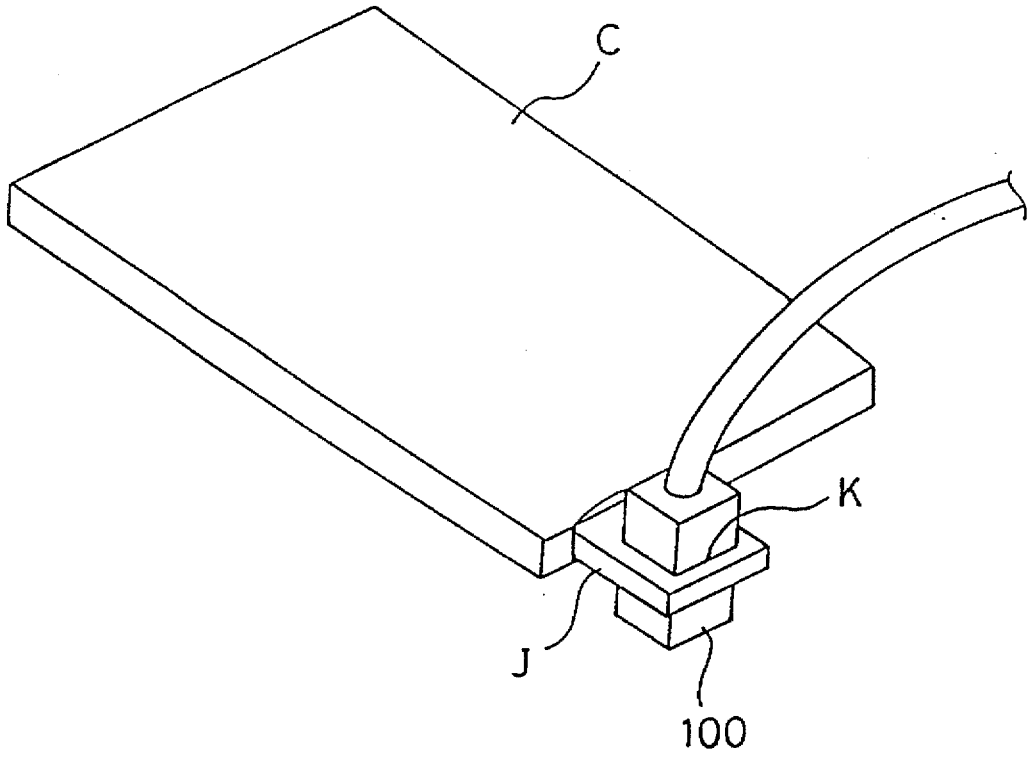
Fig. 39 PRIOR ART
FIG. 39 is an explanatory view showing a use condition of a conventional card.
Figure 40:
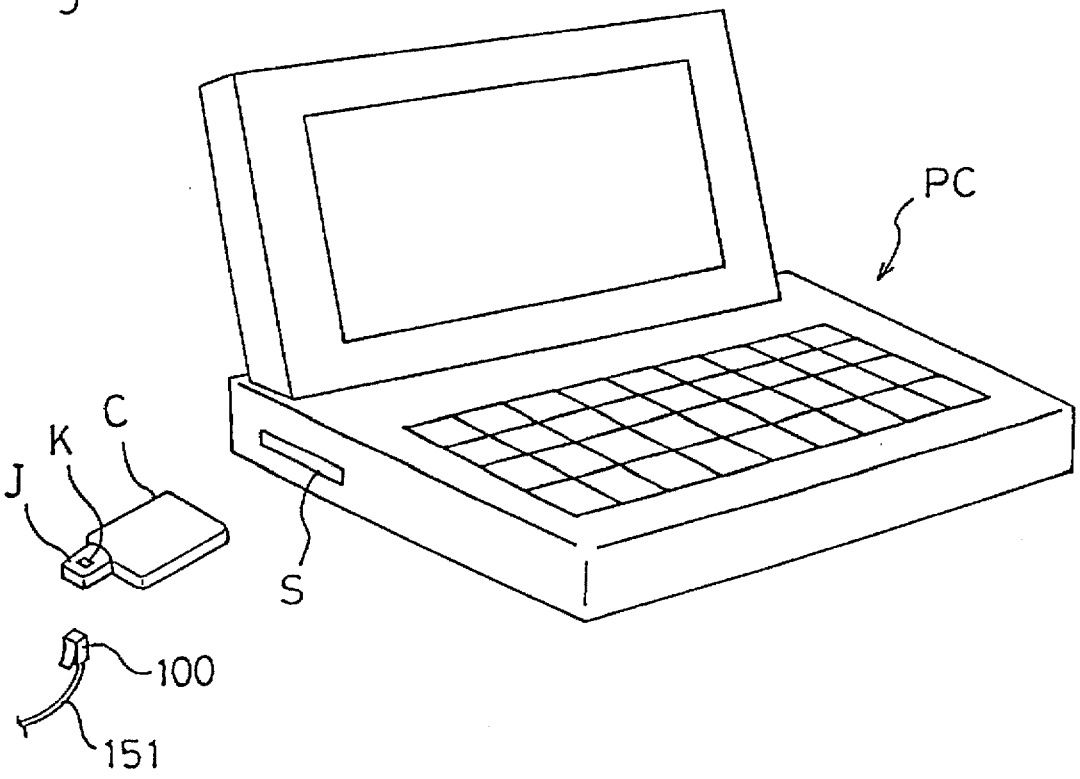
Fig. 40 PRIOR ART
FIG. 40 is an explanatory view showing another use condition of a conventional card.
Figure 41:
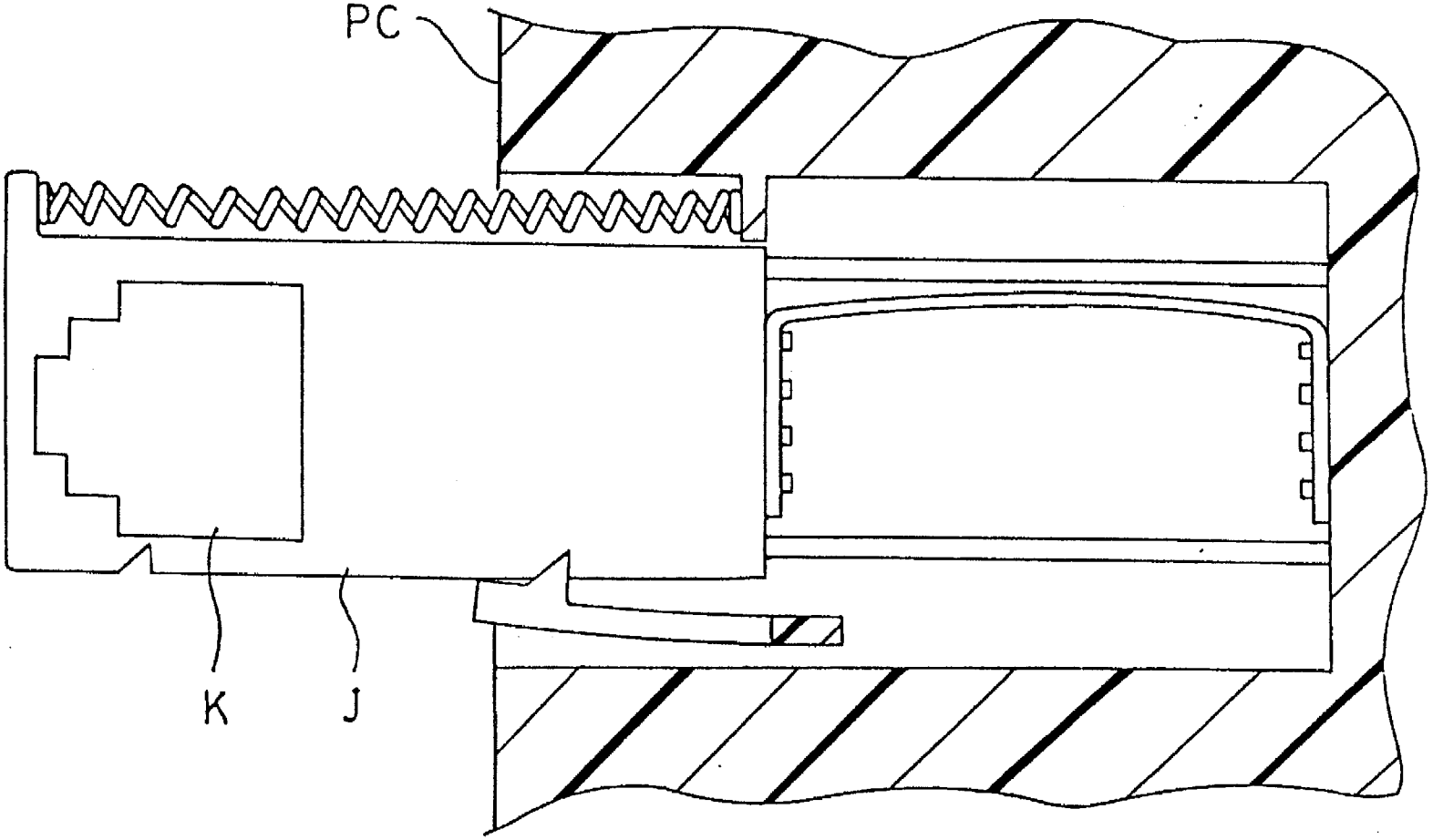
Fig. 41 PRIOR ART
FIG. 41 is a section view of main portions of a prior an electronic apparatus of a personal computer type.
Figure 42:
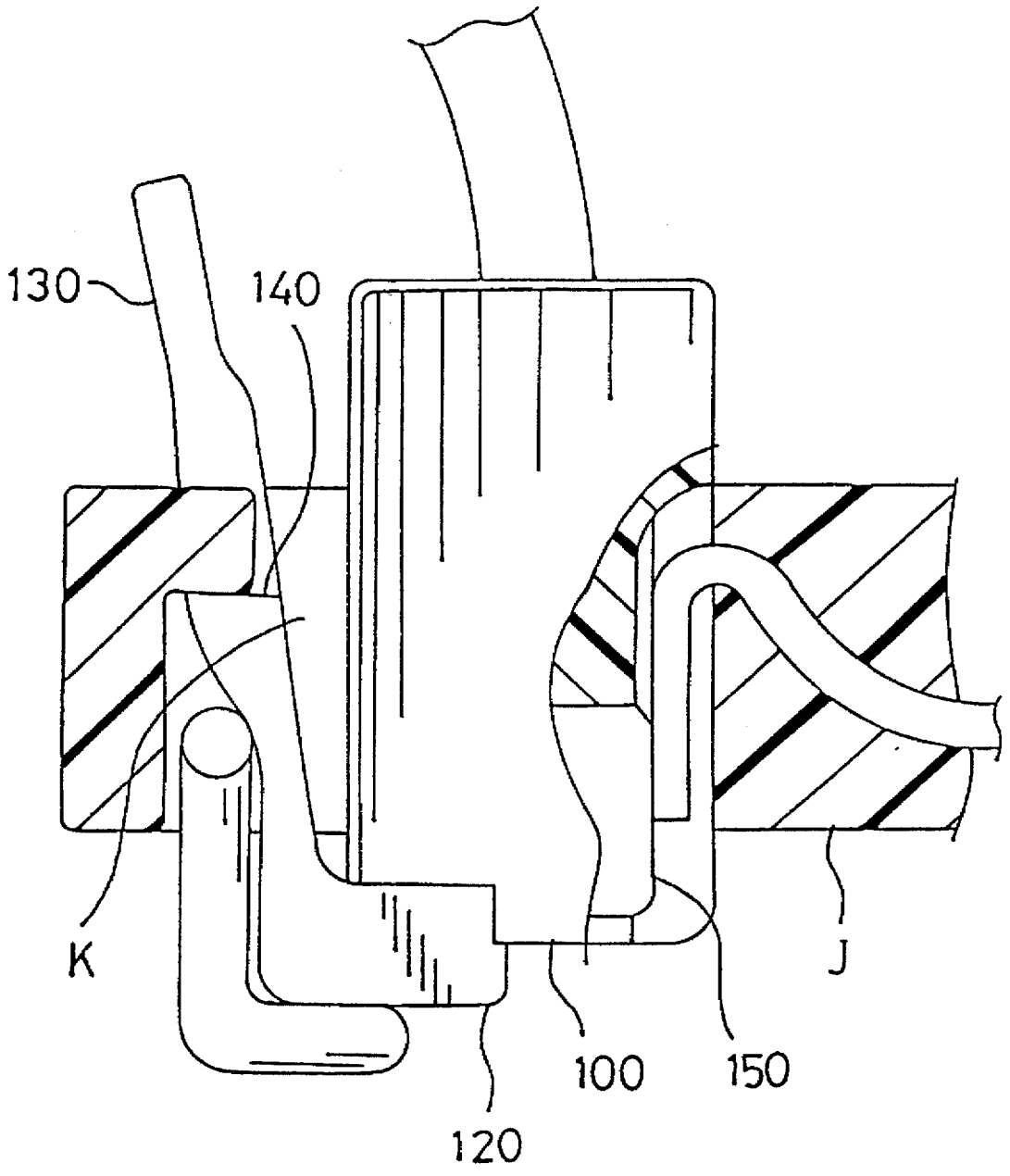
Fig. 42 PRIOR ART
FIG. 42 is a section view showing a use condition of the jack shown in FIG. 41.

In the plug 100 shown in FIG. 36, the horizontal width of the protruding portion 120 is slightly smaller than the horizontal width of the recessed portion 15 (FIGS. 1, 12, and 13) in the base member 1. In other words, the recessed portion 15 has a horizontal width which is slightly larger than that of the protruding portion 120. The cover member 2 is provided with a protruding piece portion 28 which protrudes at a position facing the recess 15 when the cover member 2 is in the closed position.

Figure 2:
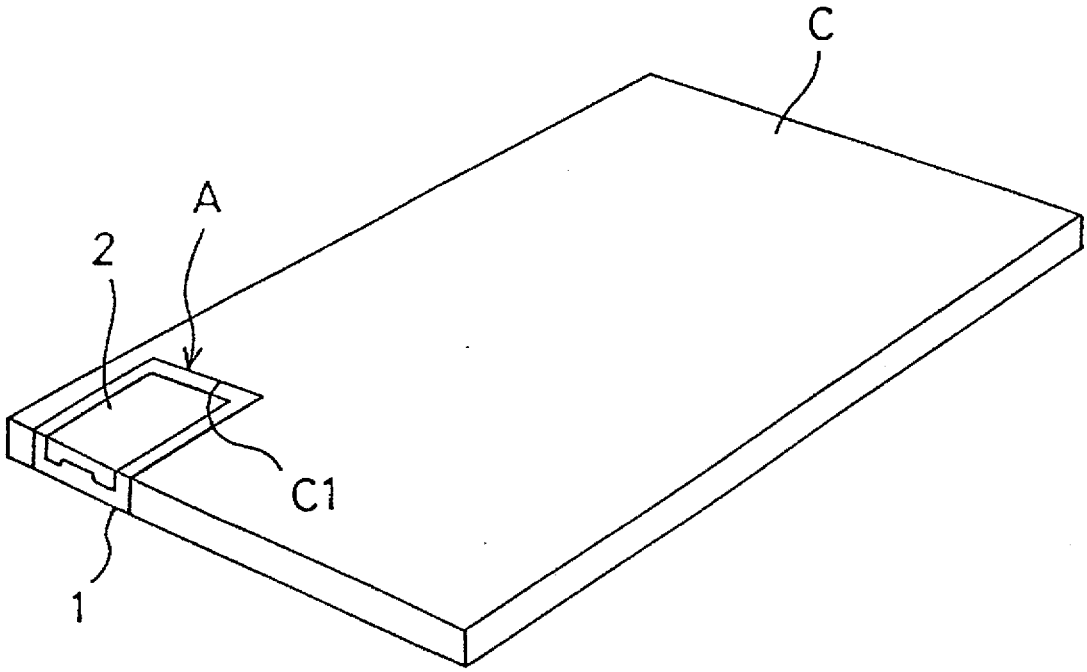
FIG. 2 is an external view showing a first embodiment of the electronic apparatus of a card type according to the present invention.
Figure 3:
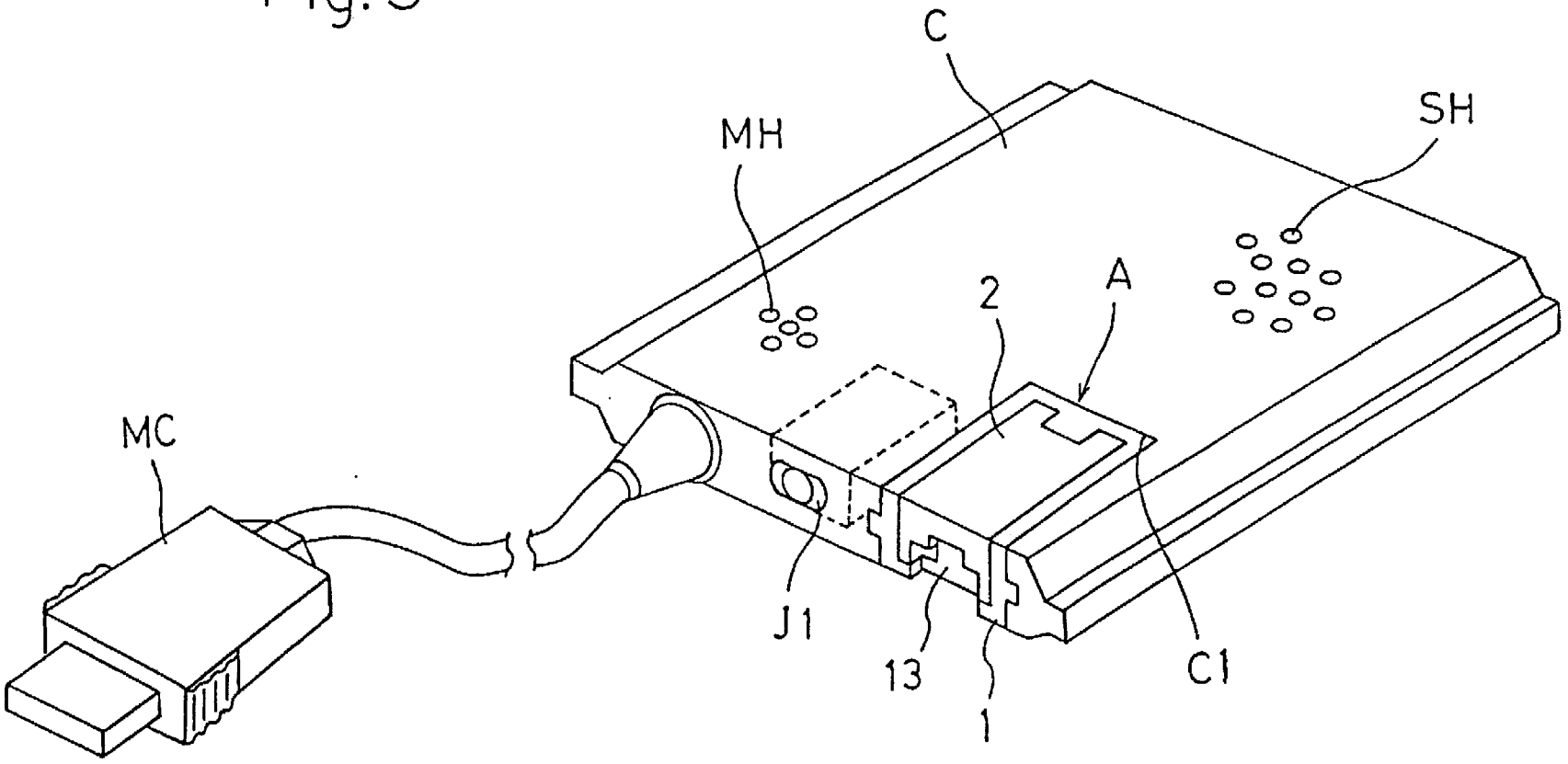
FIG. 3 is an external view showing a second embodiment of the electronic apparatus of a card type according to the present invention.

FIG. 2 shows a first embodiment of the electronic apparatus of a card type, and FIG. 3 shows a second embodiment of the electronic apparatus of a card type.

The cards C shown in FIGS. 2 and 3 both use the connector A shown in FIG. 1. In the card C shown in FIG. 3, an entry of a jack J1 to which a plug of a headphone or an earphone is connected is exposed on one end face, and a multipolar connector MC is connected via a cable. In addition, sound holes SH and MH for a loudspeaker and a microphone are formed in the front face.

In each of the cards C shown in FIGS. 2 and 3, the connector A is accommodated in and held by a recessed portion C1 which is formed in one end portion of the card C. This will be described more specifically with reference to FIGS. 1 and 9. Long ridges 10, 10 which are disposed on the side walls 16, 16 of the base member 1 of the connector A are inserted into long grooves C2, C2 formed in the side wall faces of the recessed portion C1, whereby the connector A is accommodated in and held by the recessed portion C1. The reference numeral 10*a* designates retention notches.

As seen from FIGS. 10 to 13, the height of the box-like base member 1 is equal to the thickness of the card C. Accordingly, when the cover member 2 is closed, i.e., when not in use, the upper face and the lower face of the connector A are substantially flush with the surface and the back face of the card C. When the cover member 2 is closed, the connector A constitutes a portion of the card C. When not in use, the connector A does not protrude from the surface or the back face of the card C, so that portability of the card C is not lost.

The function of the cards C constructed as shown in FIGS. 2 and 3 will be described.

Figure 9:
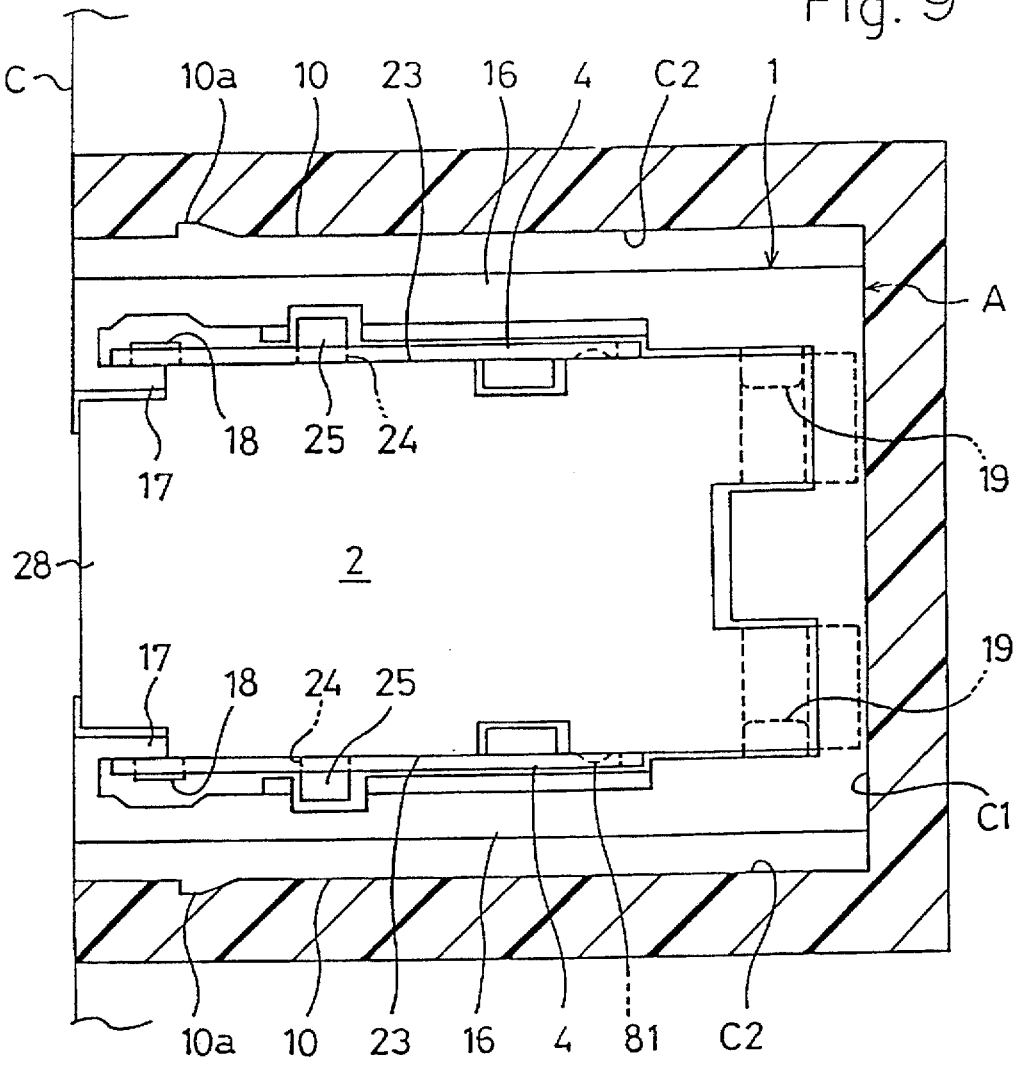
FIG. 9 is a partial plan view showing the main portions of the card shown in FIG. 3 in a broken manner.
Figure 10:
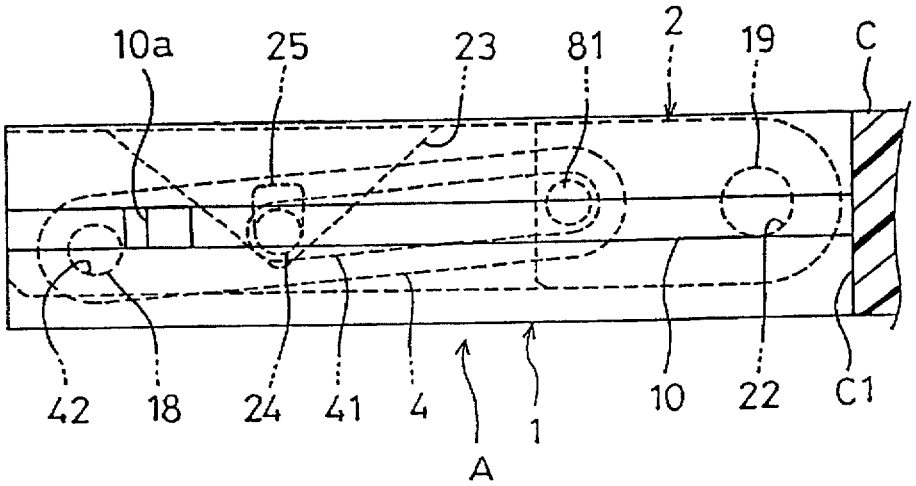
FIG. 10 is a side view showing a condition where a cover member of a connector assembled in the card shown in FIG. 2 or 3 is closed.

As shown in FIGS. 9 and 10, if the cover member 2 is closed, the aperture 11 of the base member 1 is closed by the cover member 2, so that the terminal member 3 is covered with the cover member 2. Accordingly, it is possible to prevent a human body from touching the terminal member 3, and dust and dirt from attaching to the terminal member 3. Therefore, even when a high voltage is handled, electric shock hazards can be reduced, and a situation in which the terminal member 3 contaminated by dust and dirt causes the connection failure to occur when in use can be eliminated.

Figure 14:
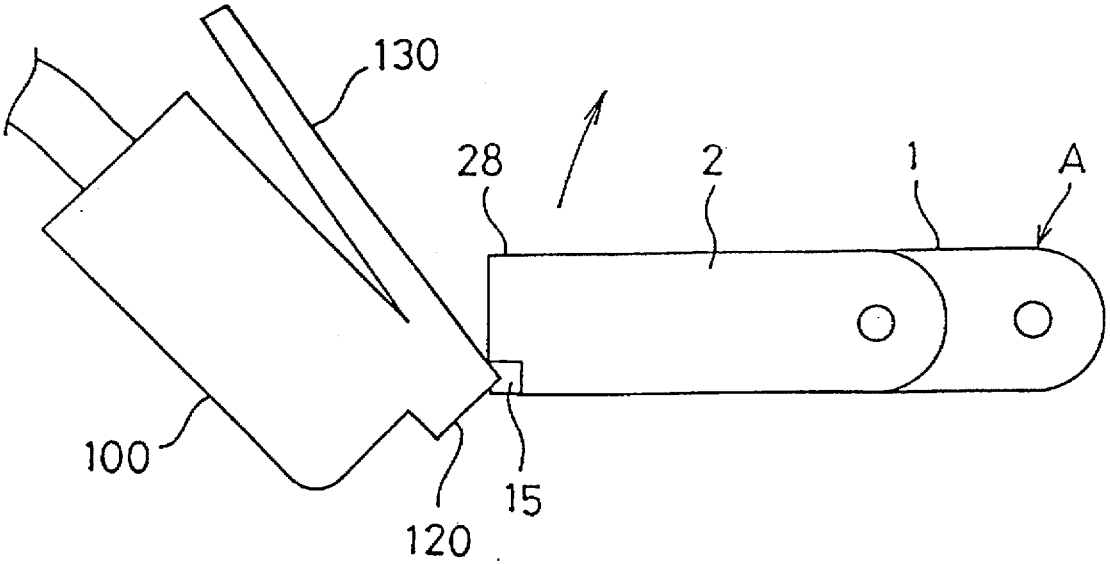
FIG. 14 is an explanatory view showing the operation for opening a cover member of a connector by using a modular plug.
Figure 15:
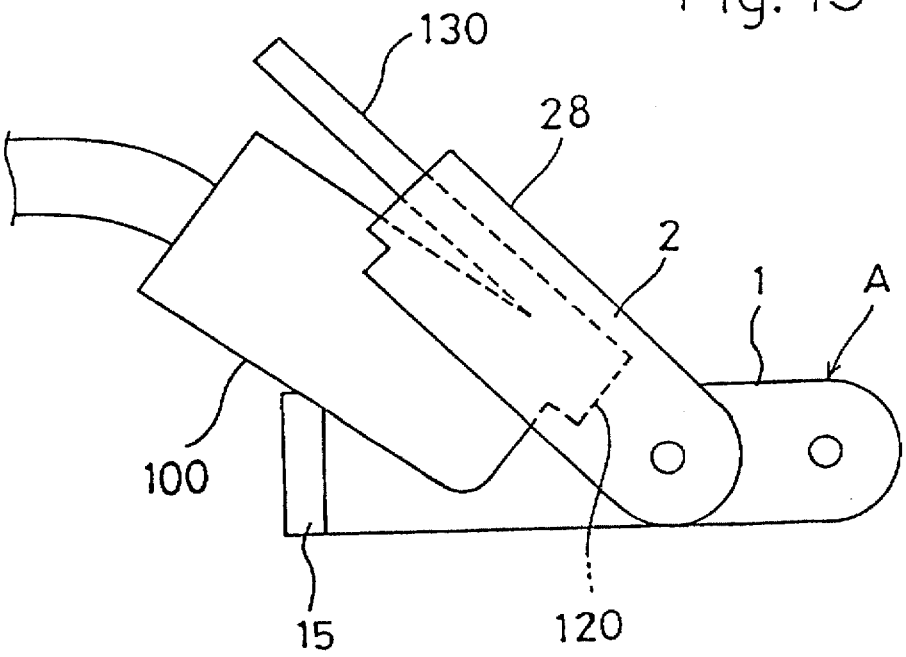
FIG. 15 is an explanatory view showing a condition where a modular plug is inserted and connected to a connector in which a cover member is opened by the modular plug.

In the connector A, if one end portion of the cover member 2 in the closed position is lifted, and pivotally opened about the shaft 19, the projection 24 moves in the long hole 41 of the link 4, and the link 4 is pivotally moved about the shaft 18. Then, the projection 24 is engaged with the edge portion of the long hole 41, so that the open angle of the cover member 2 is restricted. In this case, as shown in FIG. 14, while the protruding portion 120 of the modular plug 100 which is held by hand is inserted into the recessed portion 15 of the base member 1, the protruding piece portion 28 of the cover member 2 is pulled up by the protruding portion 120 as indicated by arrow in the figure. Then, as shown in FIG. 15, the modular plug 100 is pushed as it is into the accommodating space between the receiving face 12 and the cover member 2, so that the modular plug 100 is received by the receiving face 12 (see FIG. 1). At the same time, the arm portion 130 is deformed in a direction toward the connector body 110 while pushing the modular plug 100, and the engagement portions 140, 140 which has passed over the retaining projections 27, 27 of the cover member 2 are engaged with the retaining projections 27, 27 as a result of the recovering deformation of the arm portion 130, thereby preventing the modular plug 100 from slipping out. When the plug 100 is to be disconnected from the connector A, the arm portion 130 is deformed in a direction toward the connector body 110, so as to release the engagement portions 140, 140 from the retaining projections 27, 27. Then, the modular plug 100 is pulled out. The retaining projections 27, 27 are engaged with the engagement portions 140 of the plug 100 received by the receiving face 12, so as to prevent the plug 100 from slipping out. Accordingly, the retaining projections 27, 27 constitute the engagement mechanism.

When the receiving face 12 receives the modular plug 100, the modular plug 100 is prevented from slipping out by the retaining projections 27, 27, and the modular plug 100 is sandwiched between the receiving face 12 and the cover member 2 so that a stable use condition is attained. In addition, when not in use, the aperture 11 of the base member 1 is closed by the cover member 2, so that dust and dirt are prevented from attaching to the terminal member 3. Accordingly, it is possible to obtain high contact reliability between the terminal 150 of the plug 100 and the terminal member 3 when in use.

In the embodiment, when the cover member 2 is opened, the pair of links 4, 4 are disposed across both sides of the cover member 2 and the base member 1. Accordingly, when in use, the links 4, 4 serve also for supporting and stabilizing the plug 100 on both sides, and for enhancing the coupling strength of the base member 1 with the cover member 2.

Figure 4:
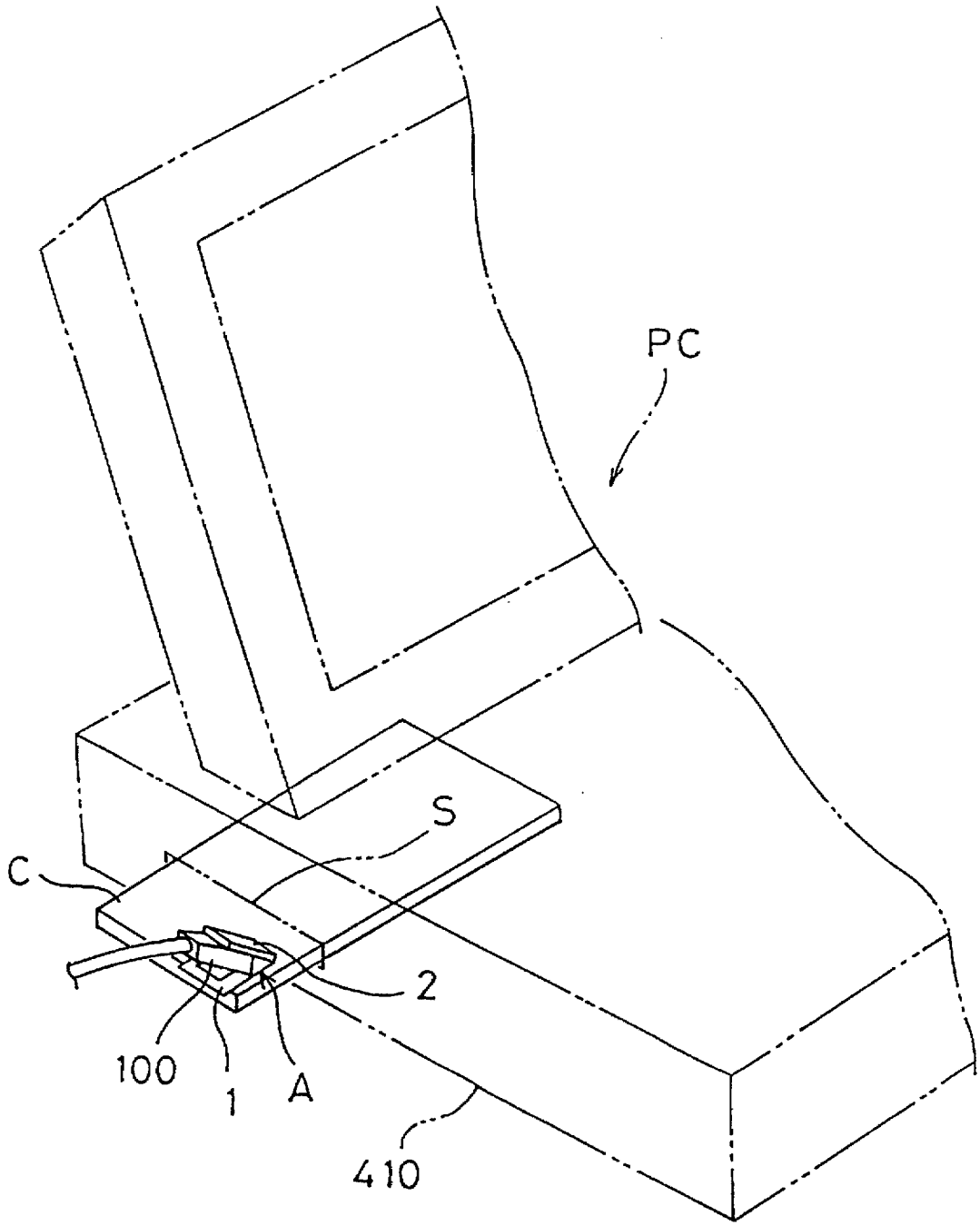
FIG. 4 is an explanatory view showing a use condition of the card shown in FIG. 3.

As shown in FIG. 4, it is possible to insert the card C into a slot S formed in a side face of a base unit 410 of a personal computer PC, and to connect the modular plug 100 to the connector A of the card C. The card C of this figure is designed so that a connector attaching portion of the card C inserted into the slot S protrudes from the slot S.

Figure 5:
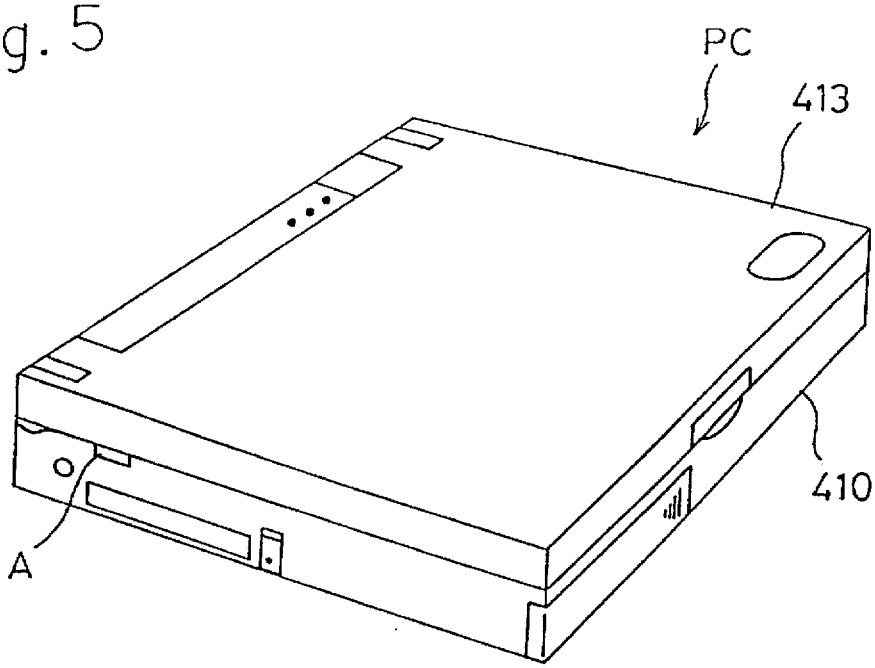
FIG. 5 is an external view of a first embodiment of the electronic apparatus of a personal computer type according to the present invention, when not in use.
Figure 6:
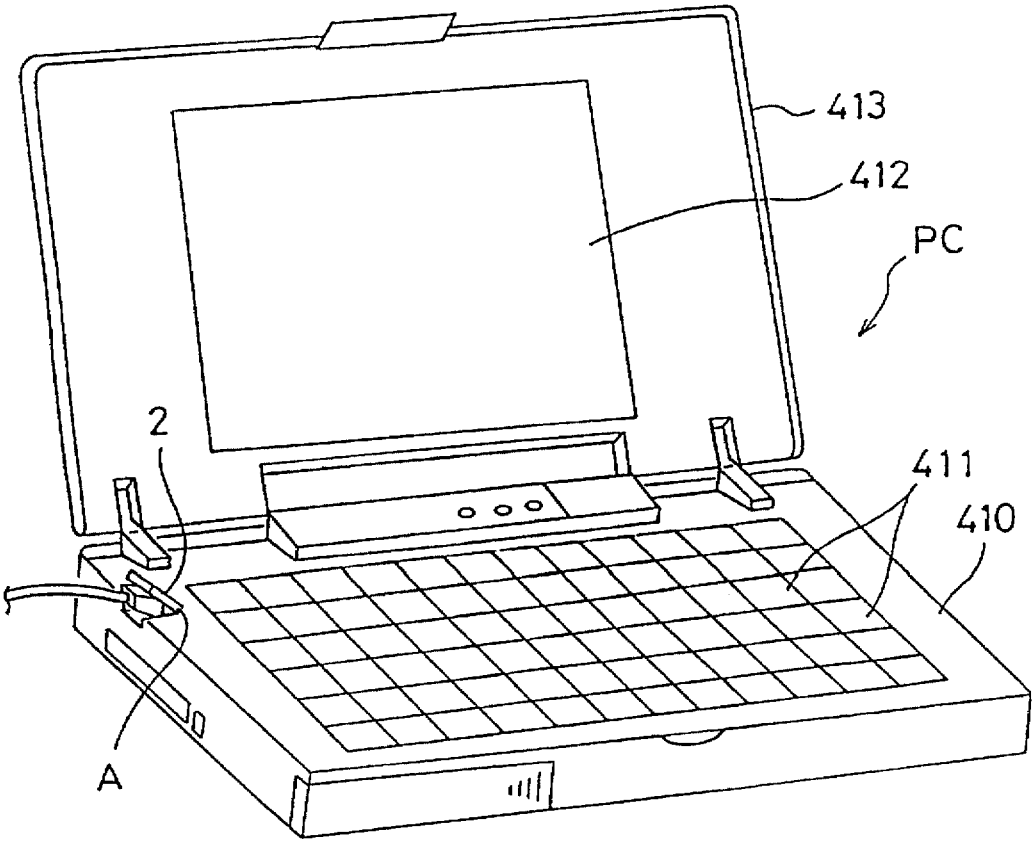
FIG. 6 is an external view of the first embodiment of the electronic apparatus of a personal computer type according to the present invention, when in use.
Figure 7:
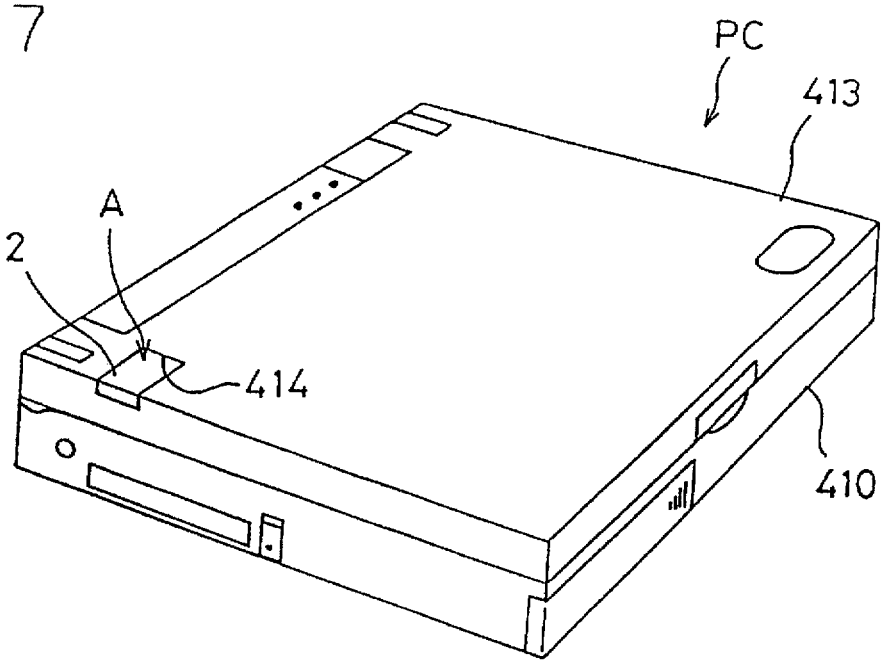
FIG. 7 is an external view of a second embodiment of the electronic apparatus of a personal computer type according to the present invention, when not in use.
Figure 8:
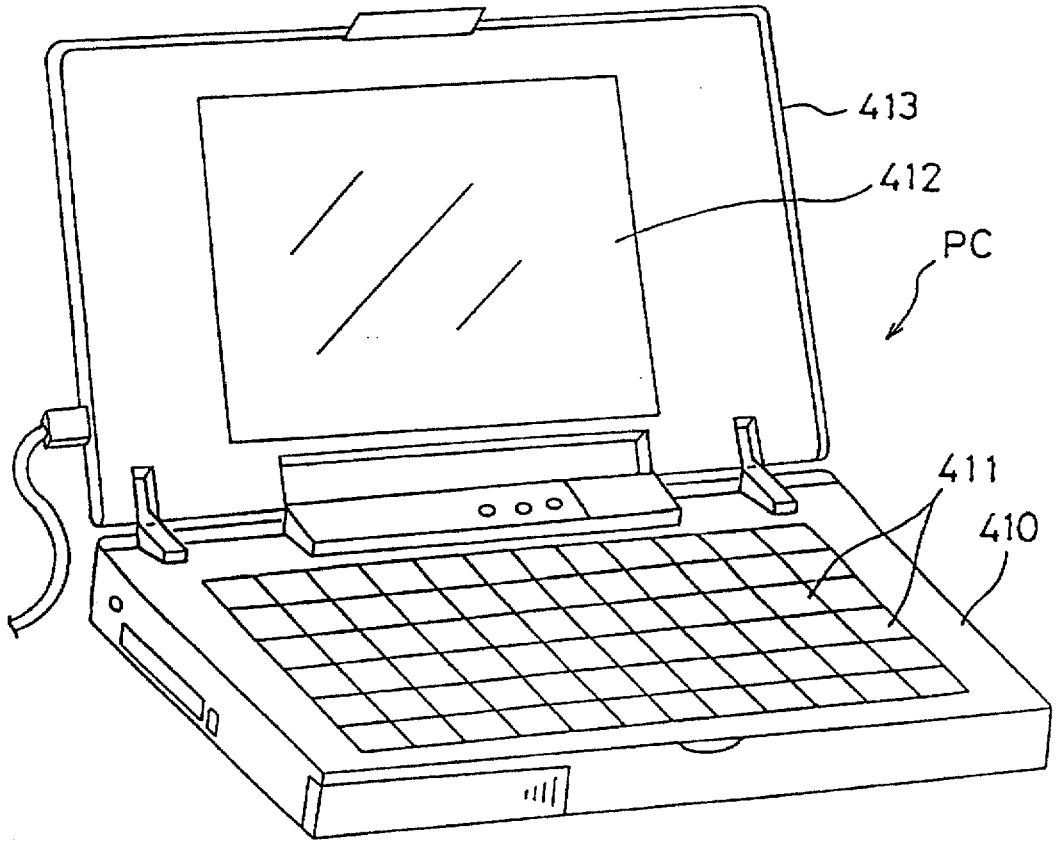
FIG. 8 is an external view of the second embodiment of the electronic apparatus of a personal computer type according to the present invention, when in use.

FIGS. 5 and 6 show a first embodiment of the electronic apparatus of a personal computer type. The electronic apparatus is a personal computer PC. The personal computer PC is provided with a base unit 410 in which a number of operation keys 411, . . . are arranged, and a cover unit 413 which has a display screen 412 and is opened or closed with respect to the base unit 410. In the personal computer PC, a connector A is attached to the base unit 410. In the embodiment, the connector A is attached to a left rear corner of the base unit 410. Alternatively, the connector may be desirably attached to any other portion of the base unit 410. In the personal computer PC shown in FIGS. 7 and 8, the base member 1 of the connector A is fitted into and attached to a recessed portion 414 formed in the cover unit 413. The base member 1 may be desirably attached to any other portion of the cover unit 413. In this way, the connector A constitutes a portion of the cover unit 413 when not in use, and few restrictions are introduced on the attachment position of the connector A. In the condition where the cover member 2 of the connector A is closed when not in use, the surface of the cover member 2 is flush with that of the cover unit 413.

Figure 16:
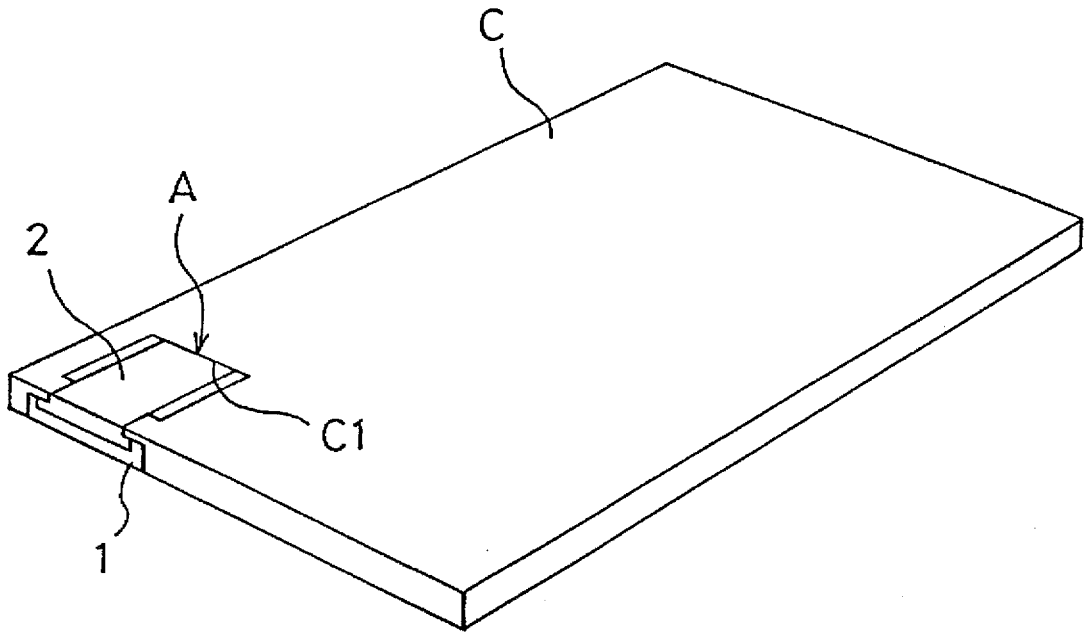
FIG. 16 is an external view showing a third embodiment of the electronic apparatus of a card type.
Figure 18:
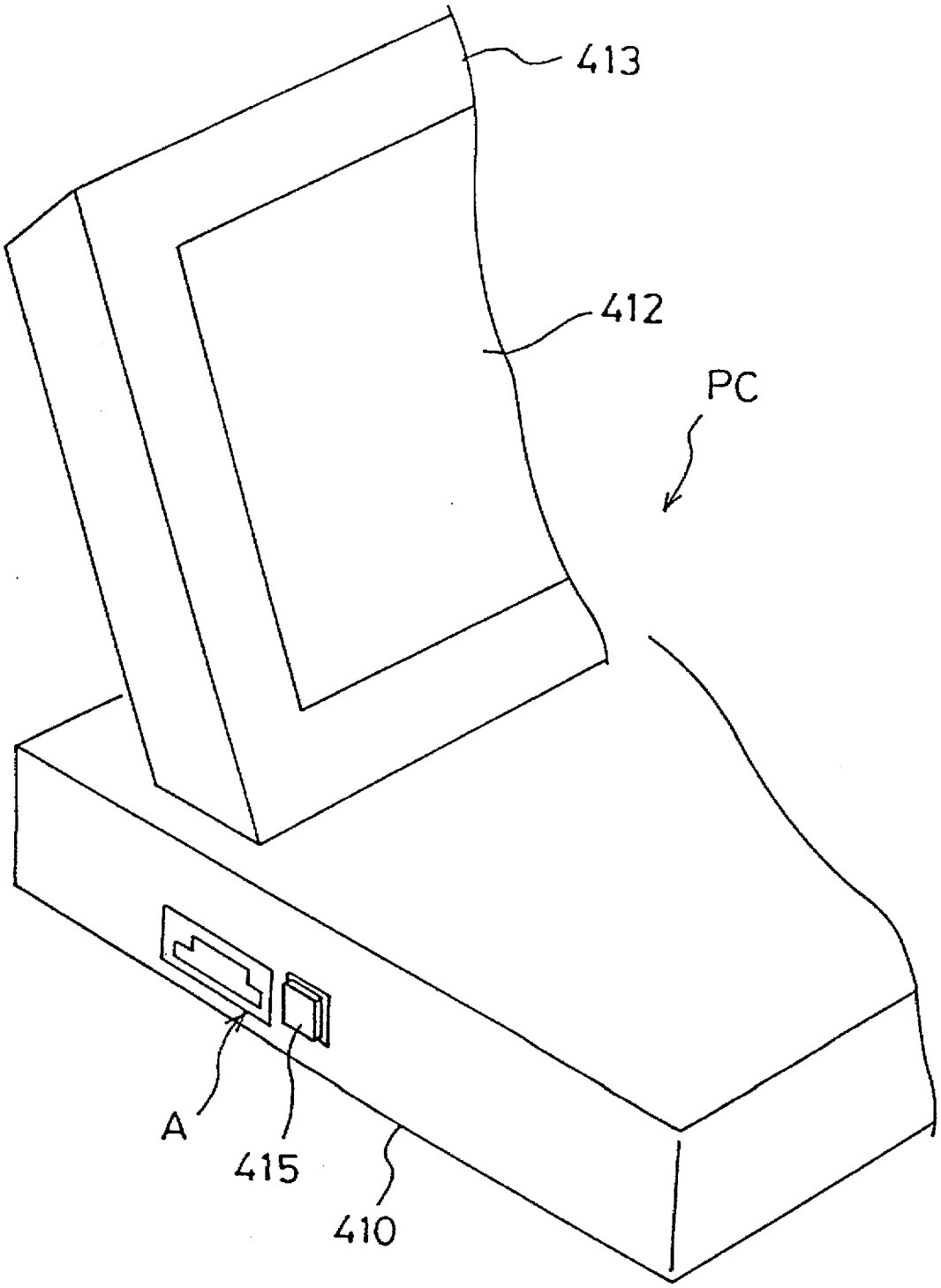
FIG. 18 is an external view showing a third embodiment of the electronic apparatus of a personal computer type according to the present invention, when not in use.
Figure 19:
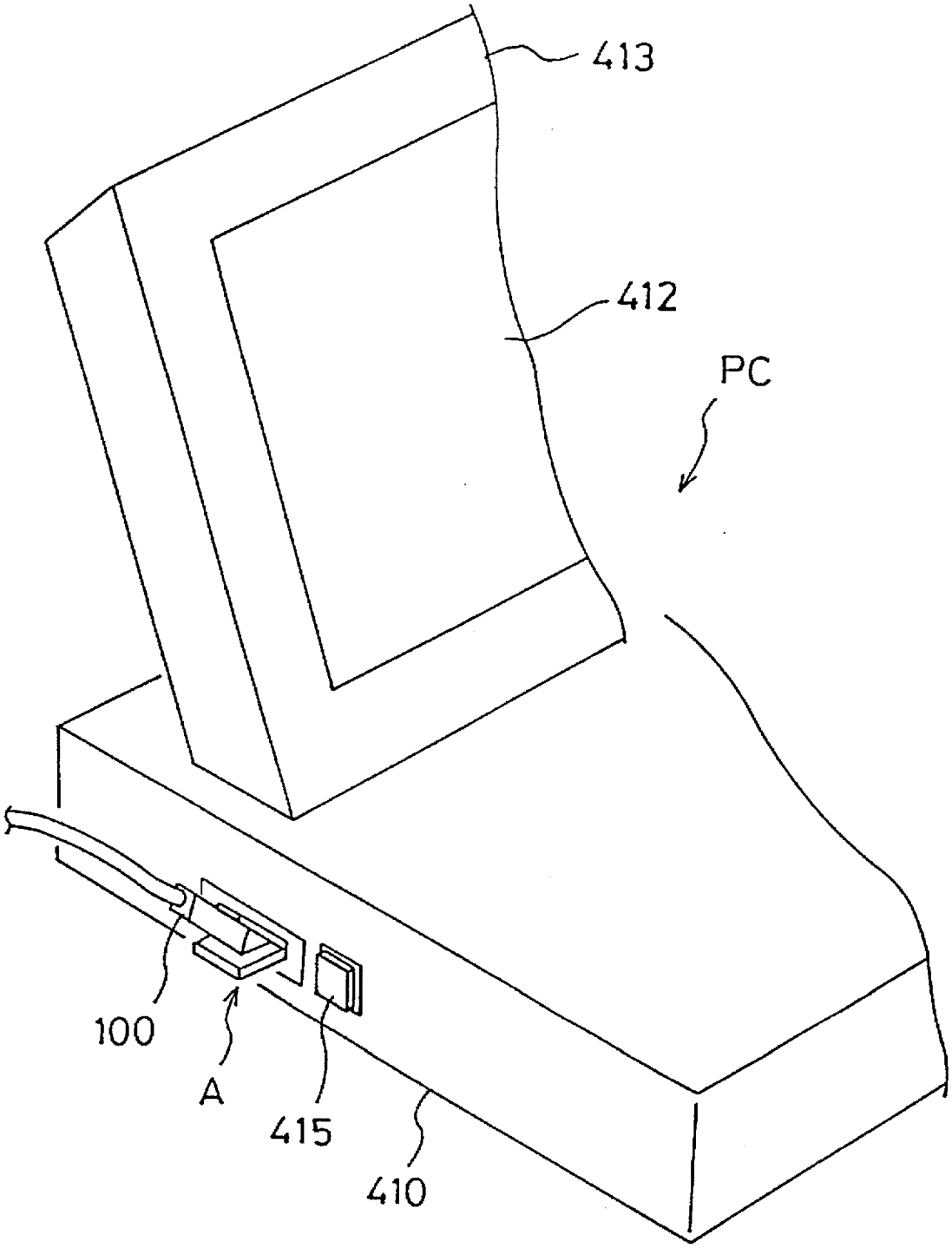
FIG. 19 is an external view showing the third embodiment of the electronic apparatus of a personal computer type according to the present invention, when in use.

FIG. 16 shows a third embodiment of the electronic apparatus of a card type (described later), and FIGS. 18 and 19 show a third embodiment of the electronic apparatus of a personal computer type (described later).

As shown in FIGS. 20 to 23, in the connector A, the base member 1 comprises spring bracket protrusions 5, 5 in one end portion thereof. Extruding spring members 51, 51 each consisting of a coil spring are interposed between the spring bracket protrusions 5, 5, and the end wall face of the recessed portion C1 which is deeply recessed in the card C (the recessed portion C1 in the embodiment has a bottom face), in a compressed condition. On the other hand, the ridges 10, 10 formed along the side walls 16, 16 of the base member 1 are slidably fitted into grooves C2 of the recessed portion C1. With this construction, the base member 1 is held by the recessed portion C1 of the card C so as to be retractable in the depth direction (indicated by a symbol D in FIG. 21), and is always urged by the force of the extruding spring members 51, 51 in a direction to protrude from the recessed portion C1.

In the cover member 2, shafts 19, 19 which are disposed in one end portion of the base member 1 are relatively pivotally fitted into circular holes 22, 22 in one end side of the side walls 21, 21. As shown in FIGS. 21 to 25, opening spring members 52, 52 are interposed between the cover member 2 and the base member 1 so as to always urge the cover member 1 in an opening direction. By the force of the opening spring members 52, 52, the cover member 1 is always urged in the opening direction. As the opening spring members 52, 52, torsion coil springs are used.

Figure 20:
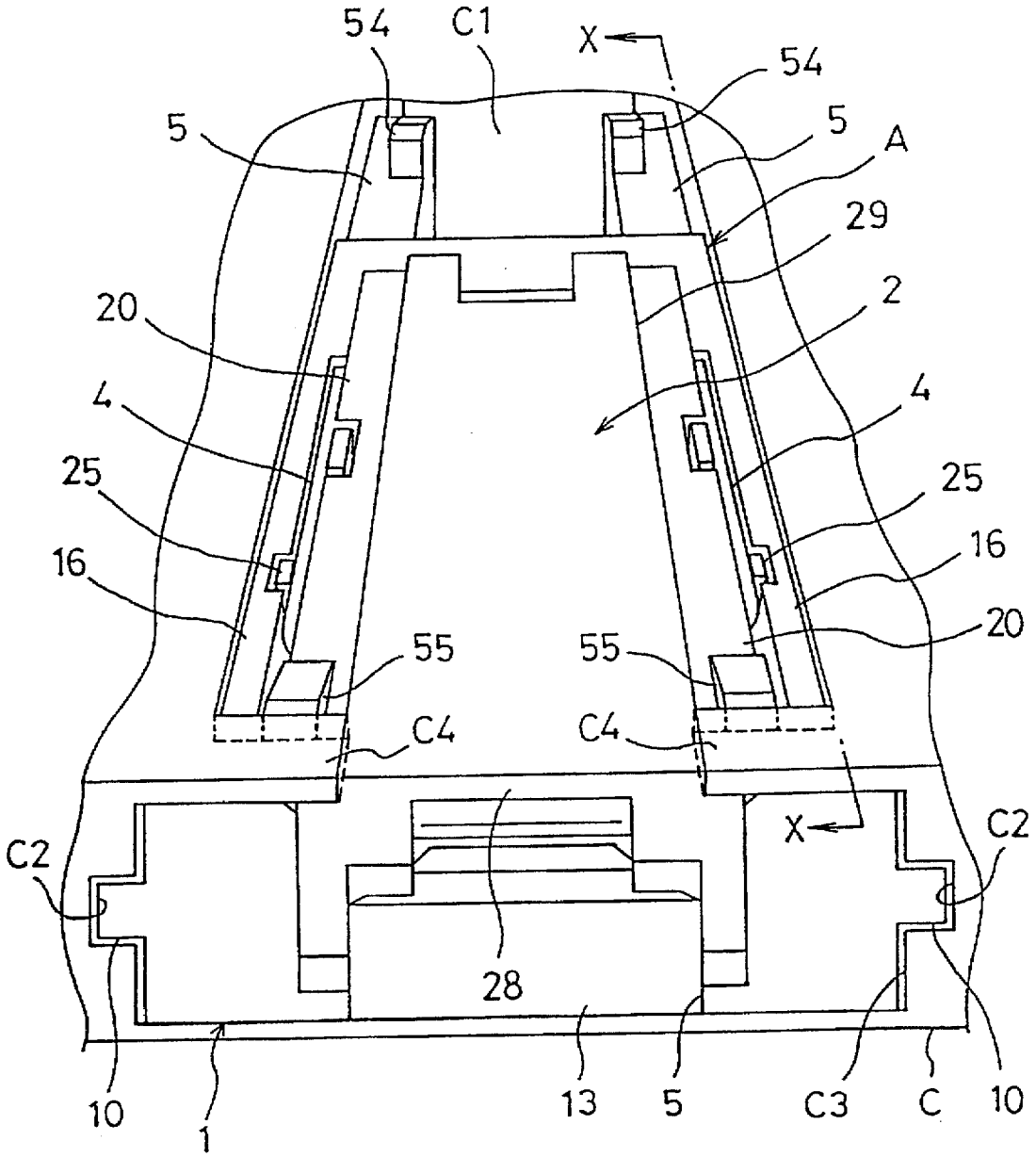
FIG. 20 is a partial perspective view showing the main portions of the card shown in FIG. 16.
Figure 21:
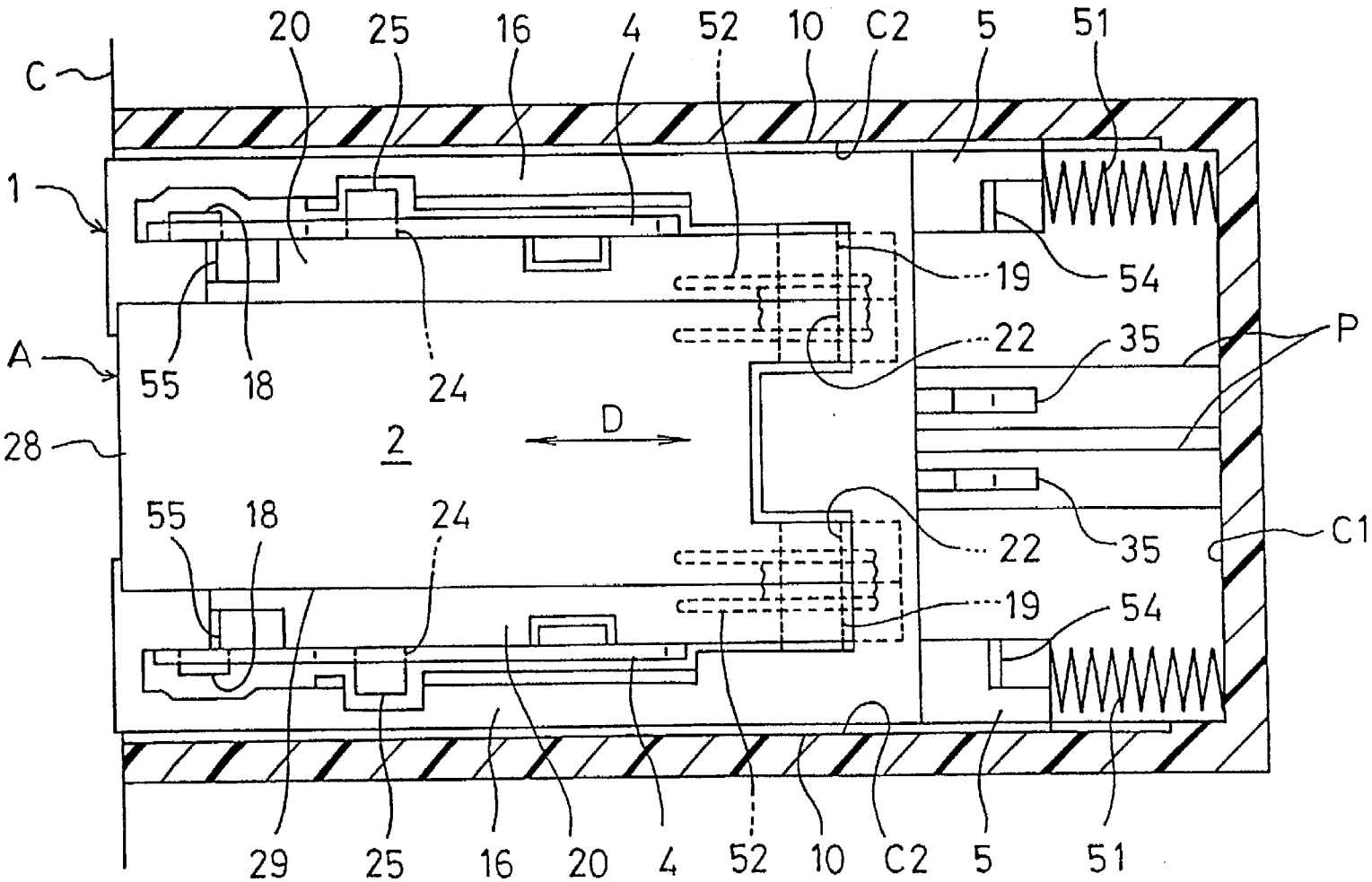
FIG. 21 is a partial plan view showing the main portions of the card shown in FIG. 16 in a broken manner.

As shown in FIG. 20, on both sides of an entrance aperture C3 of the recessed portion C1 in the card C (a cutout portion in an end face of the card C in the formation portion of the recessed portion C1), protruding pieces C4, C4 protrude so as to oppose each other in a direction across the entrance aperture C3 in the surface side of the card C. An upper plate portion 29 of the cover member 2 is slidably fitted between the protruding pieces C4, C4.

The spring bracket protrusions 5, 5 have first engagement members 54, 54. Slide portions 20, 20 elongate in a stepped manner from both sides of the upper plate portion 29 in the cover member 2. Second engagement members 55, 55 are disposed on the slide portions 20, 20. Herein, the first engagement members 54, 54 abut against the protruding pieces C4, C4 when the base member 1 protrudes from the recessed portion C1 of the card C, so as to have the function of preventing the base member 1 from slipping out of the recessed portion C1. Accordingly, the height of the first engagement members 54, 54 is set so that they can be engaged with the protruding pieces C4, C4. The second engagement members 55, 55 are engaged with the protruding pieces C4, C4 when the base member 1 is retracted into the recessed portion C1, so as to have the function of preventing the base member 1 from protruding from the recessed portion C1. Accordingly, the second engagement members 55, 55 are provided with engagement faces **55*a*, 55*a*** which are engaged with the protruding pieces C4, C4 when the base member 1 is retracted from the protruded position into the recessed portion C1, and slopes **55*b*, 55*b* which are useful for passing over the protruding pieces C4, C4 in the process in which the base member 1** is retracted from the protruded position into the recessed portion C1.

In the process in which the cover member 2 is retracted together with the base member 1 from the protruded position into the recessed portion C1 of the card C, the slide portions 20, 20 slide against the force of the opening spring members 52, 52 under pressure exerted by the protruding pieces C4, C4 of the card C. When the slide portions 20, 20 slide under pressure by the protruding pieces C4, C4, the cover member 2 is moved so as to be closed, thereby gradually reducing the open angle.

In the relationship between the base member 1 and the cover member 2, the cover member 2 can be pressed into the inner space of the base member 1. That is, the cover member 2 has a moving allowance for slightly fitting into the base member 1 from the closed position with the shaft 19 as the center. By such pressing of the cover member 2, the engagement of the second engagement members 55, 55 with the protruding pieces C4 and 4 can be released.

A slide terminal 35 extends from the terminal member 3 disposed in the base member 1 (see FIGS. 1, 12, and 13). As shown in FIGS. 21 to 25, the slide terminal 35 is led to the outside from one end portion of the base member 1. The slide terminal 35 is always elastically in contact with a conductive pattern P disposed on the bottom face of the recessed portion C1 of the card C.

The other constructions of the connector A are the same as those of the connector A in the first embodiment which has been described with reference to FIG. 1, etc. For example, that the base member 1 has a thin box shape, that the receiving face 12 of a V-shaped groove-like face and the terminal member 3 are disposed inside the base member 1, that the recessed portion 15 is formed in the edge middle portion of the other end portion of the base member 1, that the link 4 and the projection 24 constitute the open position restricting mechanism for restricting the open angle of the cover member 2 with respect to the base member 1, and that the cover member 2 has a function for preventing the plug 100 from slipping out are the same as those described with reference to FIG. 1 and the like. In the embodiment, therefore, the condition in which the cover member 2 is opened and the plug 100 of the counter connector is connected corresponds to the condition shown in FIG. 13.

The functions will be described with reference to FIGS. 22 to 25. FIGS. 22 to 25 are explanatory views of various conditions corresponding to section views taken along a line X—X in FIG. 20, so that the protruding piece C4 is shown in section.

Figure 22:
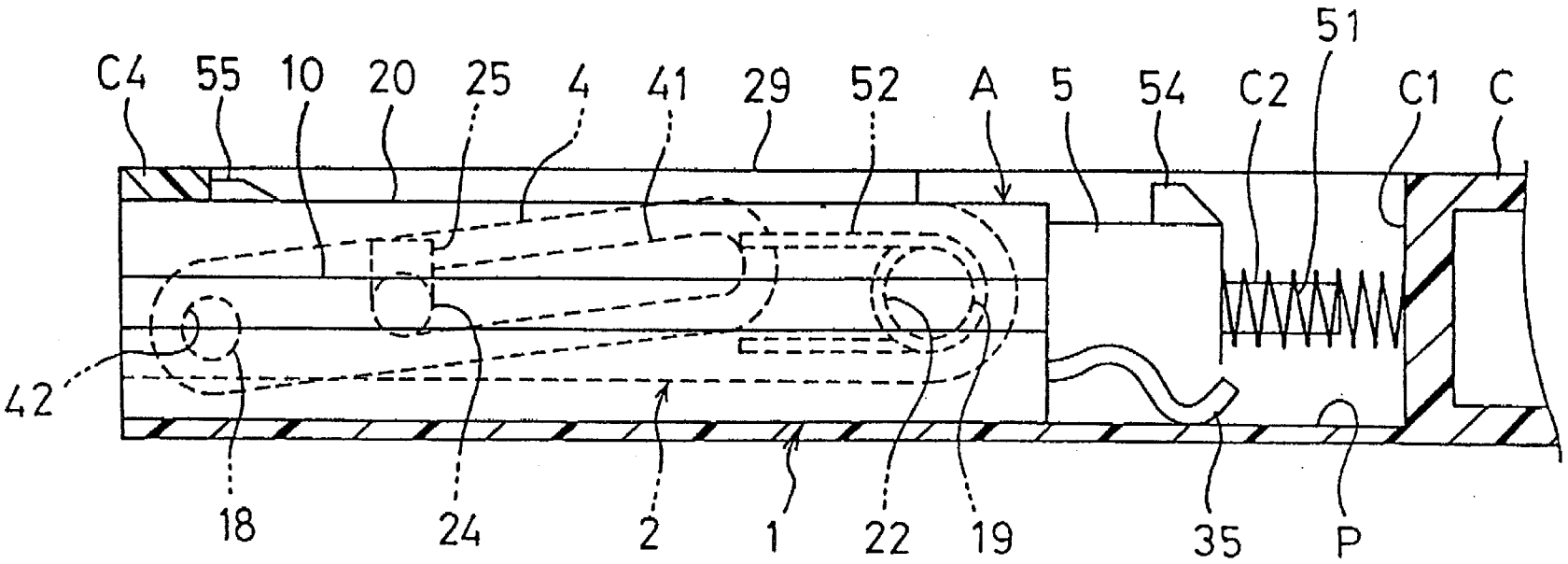
FIG. 22 is a side view of a connector assembled in the card shown in FIG. 16.

When the base member 1 is retracted in the recessed portion C1, as shown in FIG. 22, the slide portions 20, 20 of the cover member 2 are pressed by the protruding pieces C4, C4 of the recessed portion C1. Accordingly, even if the force of the opening spring member 52 is applied to the cover member 2, the cover member 2 remains in its closed position. Since the second engagement members 55 are engaged with the protruding pieces C4, C4, the base member 1 is retained in the recessed portion C1, even when the base member 1 is urged in the protruding direction by the extruding spring member 51.

Figure 23:
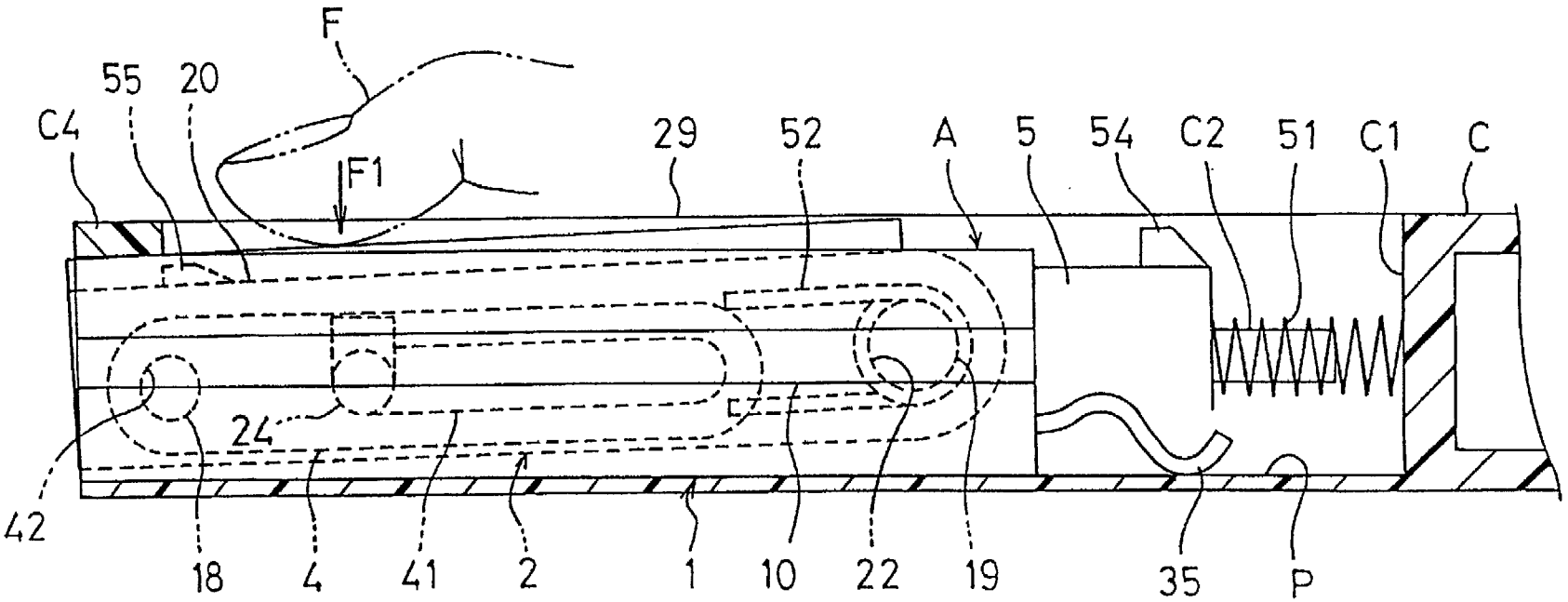
FIG. 23 is a view illustrating a function of a connector assembled in a card.
Figure 24:
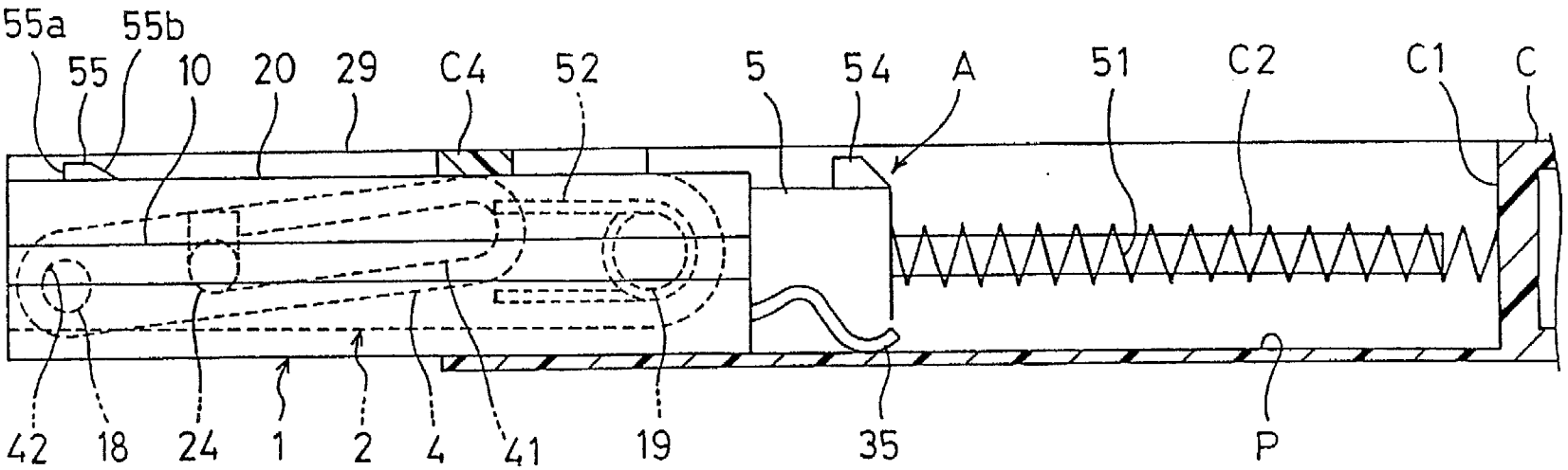
FIG. 24 is a view illustrating a function of a connector assembled in a card.
Figure 25:
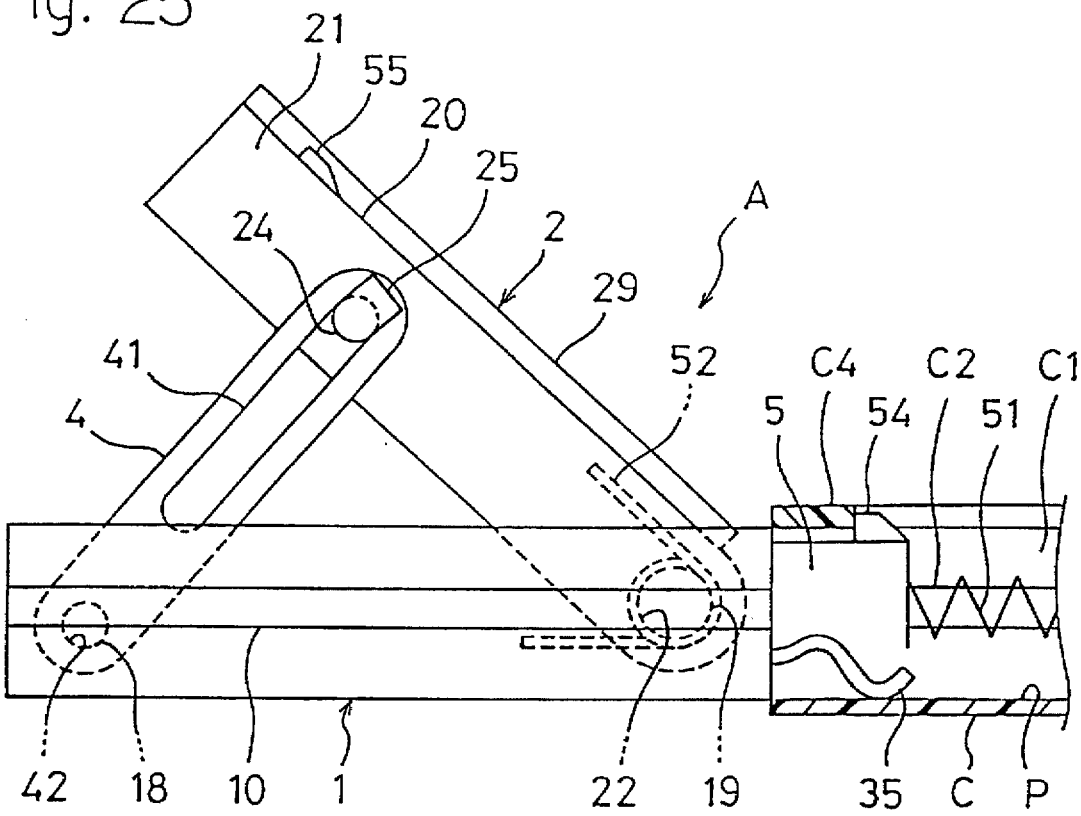
FIG. 25 is a view illustrating a function of a connector assembled in a card.

When the cover member 2 is pressed by a finger tip F into the inner space of the base member 1 as indicated by the arrow F1, as shown in FIG. 23, so as to release the engagement of the second engagement members 55 with the protruding pieces C4, the base member 1 is extracted (protruded) together with the cover member 2 from the recessed portion C1 by the force of the extruding spring member 51. FIG. 24 shows a middle stage in which the base member 1 is being extracted from the recessed portion C1. As seen from the figure, in the middle stage, the slide portions 20 of the cover member 2 are slid while being pressed by the protruding pieces C4, C4, so that the cover member 2 is not opened. When the first engagement members 54 abut against the protruding pieces C4, as shown in FIG. 25, the extruding movement of the base member 1 is stopped. The pressing function of the protruding pieces C4 against the slide portions 20 of the cover member 2 is no longer exerted, so that the cover member 2 is opened by the force of the opening spring member 52. When the cover member 2 is opened in this way, the modular plug 100 can be inserted and connected in the same condition described with reference to FIG. 13.

When the base member 1 is pressed and retracted into the recessed portion C1 against the force of the extruding spring member 51, the slide portions 20 of the cover member 2 are pressed by the protruding pieces C4 in the retracting process, so as to gradually reduce the open angle. When the base member 1 is completely retracted, the slide portions 20 of the cover member 2 are pressed by the protruding pieces C4 and the cover member 2 is completely closed. At the same time, after the second engagement members 55 pass over the protruding pieces C4, the second engagement members return to positions at which they are engaged with the protruding pieces C4 by the force of the opening spring members 52, and are then engaged with the protruding pieces C4. In the embodiment, even when the base member 1 is extracted from or retracted into the recessed portion C1 of the card C, the slide terminal 35 is always elastically in contact with the conductive pattern P.

The other constructions and functions of the connector A are the same as those of the connector A in the first embodiment which has been described with reference to FIG. 1, etc. For example, that the cover member 2 prevents a human body from touching the terminal member 3 and prevents dust and dirt from attaching to the terminal member 3, that the link 4 restricts the open angle of the cover member 2, that the link 4 supports and stabilizes the plug 100 on both sides thereof when in use, and that the link 4 is useful for enhancing the coupling strength between the base member 1 and the cover member 2 when in use are the same as those described in the first embodiment for the connector A.

As seen from FIG. 16, when not in use, the upper face of the connector A is flush with the surface of the card C. When the cover member 2 is closed, the connector A constitutes a portion of the card C.

Figure 17:
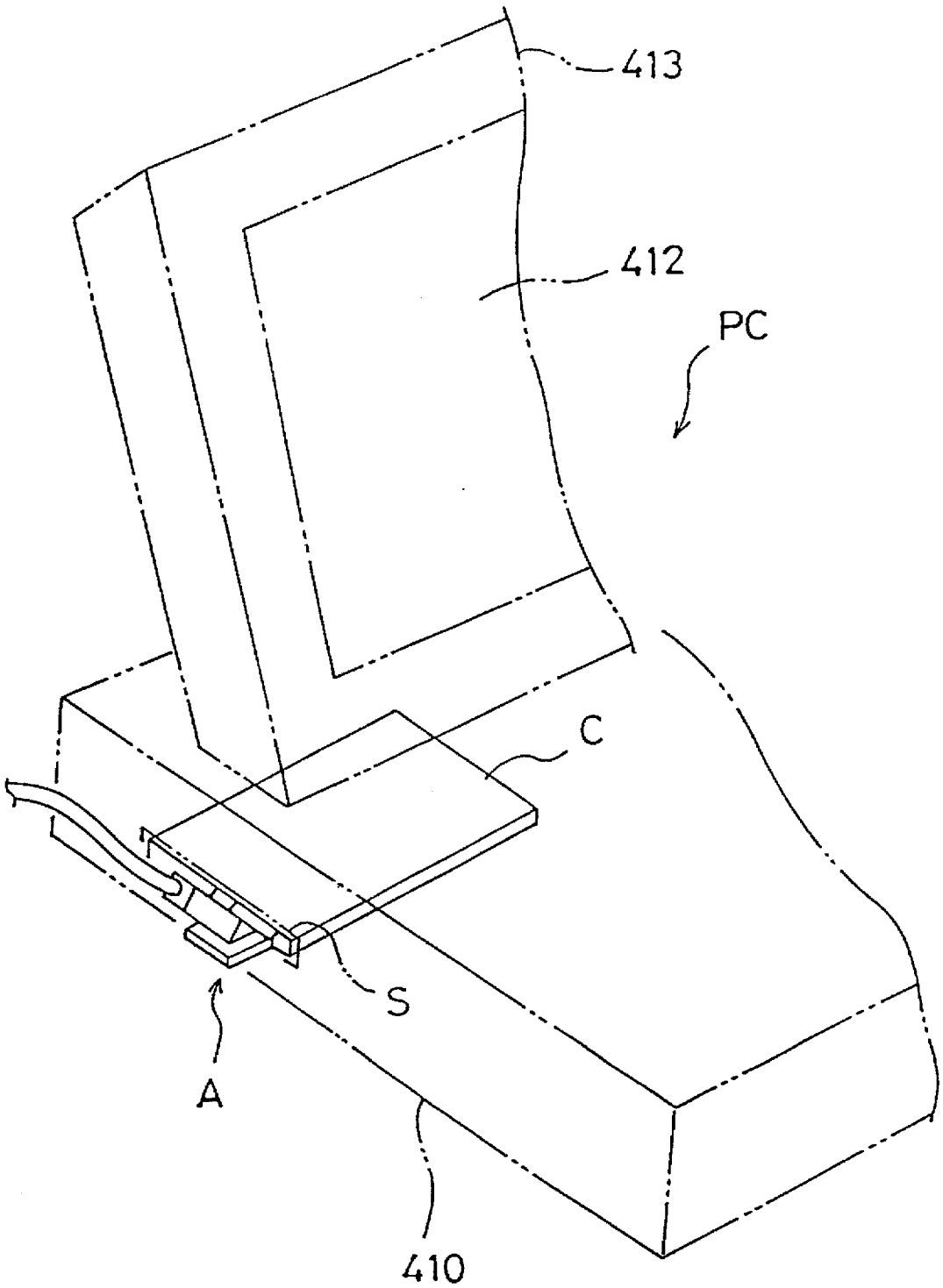
FIG. 17 is an explanatory view showing a use condition of the card shown in FIG. 16.

As shown in FIG. 17, the card C can be inserted into a slot S formed in the side face of a base unit 410 of a personal computer PC, and the plug 100 can be connected to the connector A protruding from the card C. As shown in the figure, the connector A can be ejected and retracted, since it is possible to realize a construction in which the whole of the card C is inserted into the slot S.

A personal computer PC shown in FIGS. 18 and 19 comprises a display screen 412, and a cover unit 413 which has a base unit 410 and is opened and closed with respect to the base unit 410. The connector A is attached to the base unit 410. In the embodiment, when an eject push button 415 is pressed, the cover member 2 of the connector A is pressed into the inner space of the base member 1, so that the engagement of the second engagement members 55 with the protruding pieces C4 is released. As a result, the cover member 1 is extracted together with the cover member 2 from the recessed portion C1 by the force of the extruding spring members 51. FIG. 18 shows the condition when not in use, and FIG. 19 shows the use condition when in use.

Figure 43:
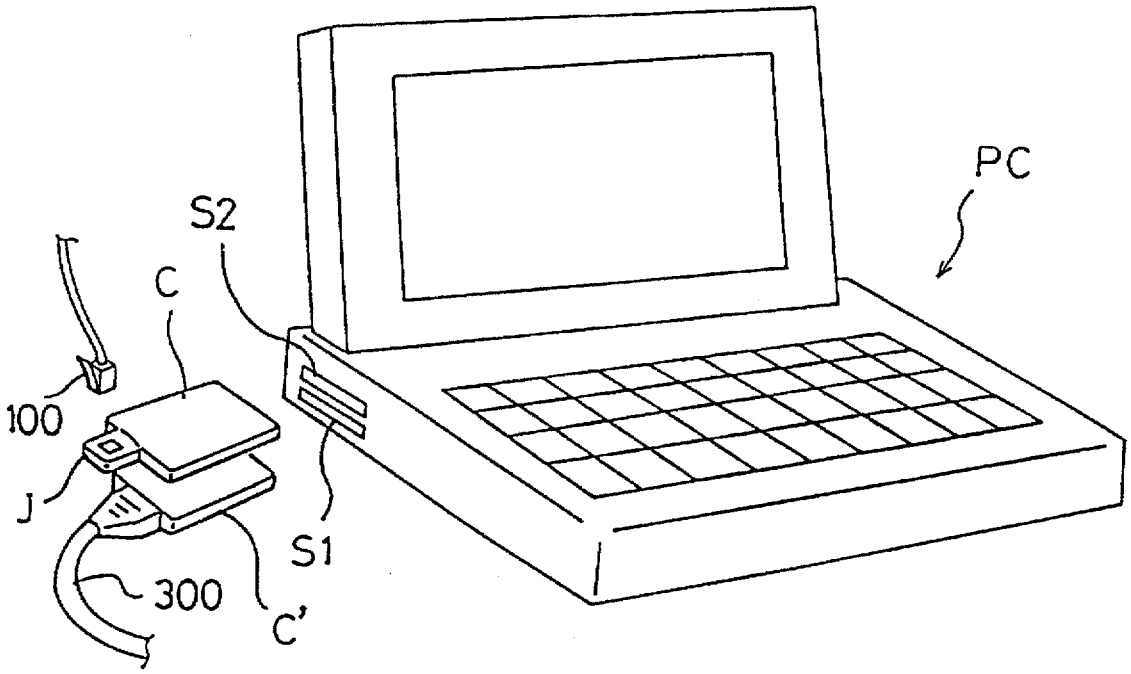
Fig. 43 PRIOR ART
Figure 44:
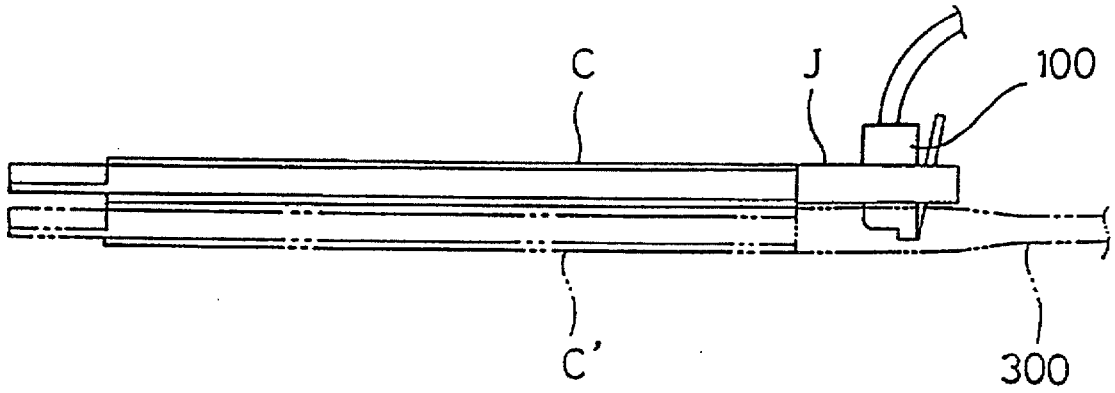
Fig. 44 PRIOR ART
FIG. 44 is an explanatory view illustrating a condition in a conventional connection system where a modular plug interferes with a cable of a card inserted into a slot.

As described with reference to FIG. 43, in some personal computers and the like, slots S1 and S2 for inserting modem cards and the like are disposed as upper and lower slots at somewhat close positions. In the case where the slots S1 and S2 are disposed in this way, if the base member 1 of the connector A is fixed to the card C as in the cards C in the first and second embodiments (see FIGS. 2 and 3), or if the cover member 2 is opened or closed with respect to the base member 1 as in the card C in the third embodiment (see FIG. 16), the protruding direction of the cover member 2 when in use is fixed to an upward direction from the card C. Consequently, if the card C is inserted and used in the lower slot S1, for example, a card inserted into the upper slot S2 and a cable may interfere with the cover member. Since the slots may be variously disposed depending on the type of personal computers, it is sometimes necessary to insert a plug into either of the two faces, i.e., into either of the surface and the back face of the card. The cards of the first, second, and third embodiments cannot handle such a requirement.

Figure 26:
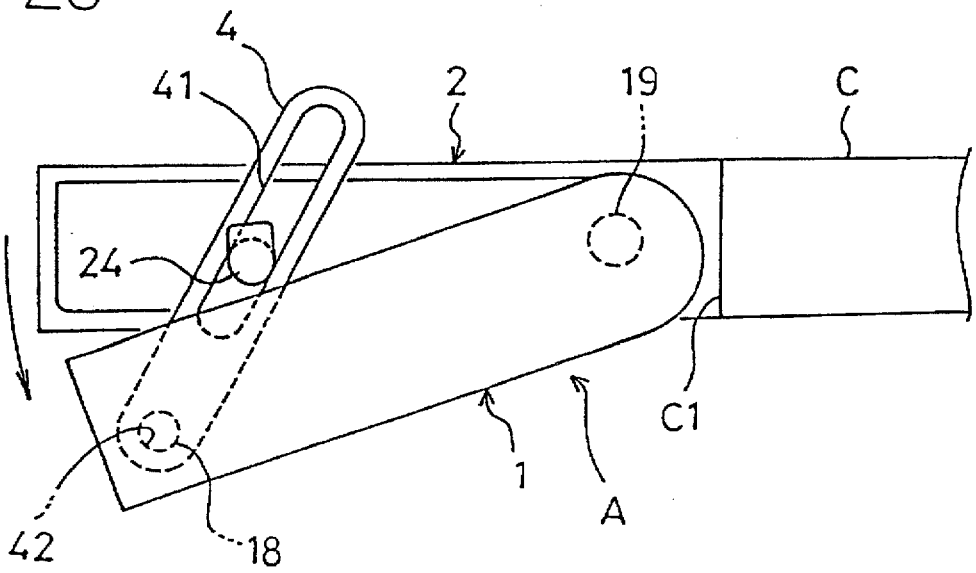
FIG. 26 is an explanatory view illustrating a problem produced when the connector of the first embodiment is used as a double openable connector.

As a proposed countermeasure for the requirement, in the connector A of the first embodiment, the base member 1 may be attached so as to be rotatable toward the back face of the card C with respect to the recessed portion C1, so that the cover member 2 can be opened in the surface side of the card C while the base member 1 is contained in the recessed portion C1, or the base member 1 can be opened in the back face side of the card C while the cover member 2 is contained in the recessed portion C1. However, if the connector A is attached to the recessed portion C1 in such a way, the link 4 is protrudes from the surface of the card C when the base member 1 is opened in the back face side of the card C while the cover member 2 is contained in the recessed portion C1, for example as shown in FIG. 26, resulting in that the countermeasure cannot satisfy the requirement.

Figure 27:
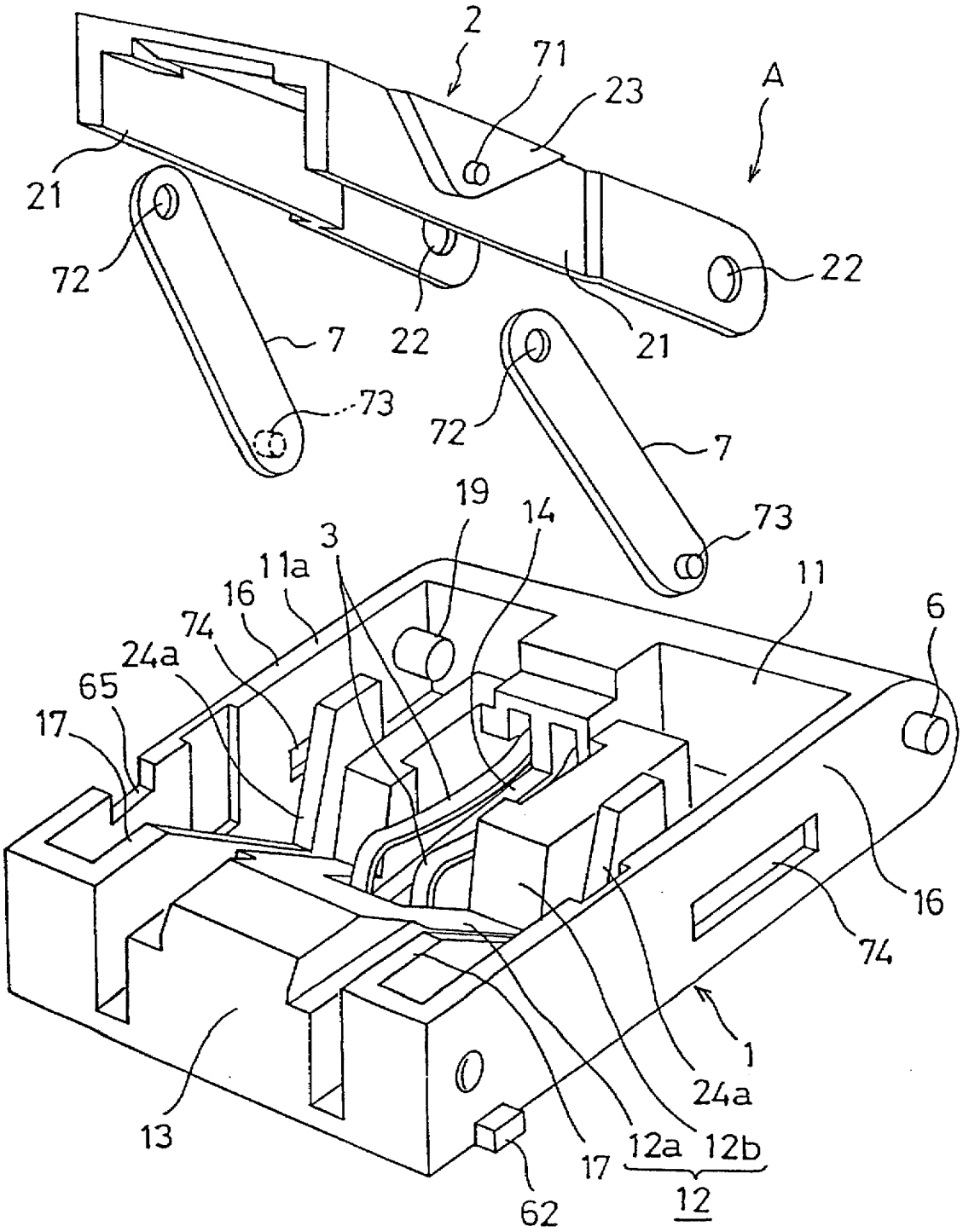
FIG. 27 is an exploded perspective view showing a second embodiment of the connector.

A connector A of a second embodiment shown in FIG. 27 has been devised in view of the above-discussed point. Referring to FIGS. 27 to 35, the connector A of the second embodiment, and the electronic apparatus of a card type of a fourth embodiment using the connector A will be described.

Figure 29:
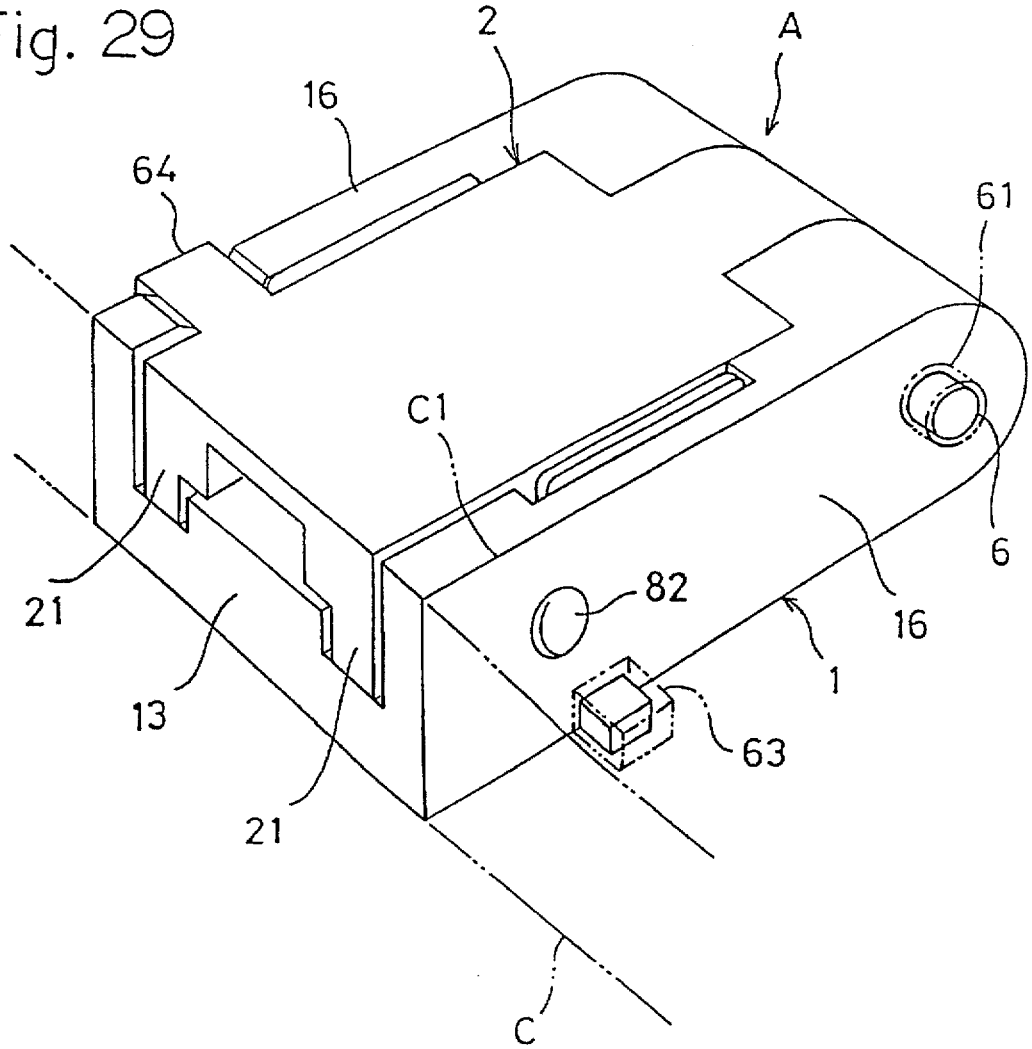
FIG. 29 is an explanatory view showing a condition where a connector is assembled in the card shown in FIG. 28.
Figure 30:
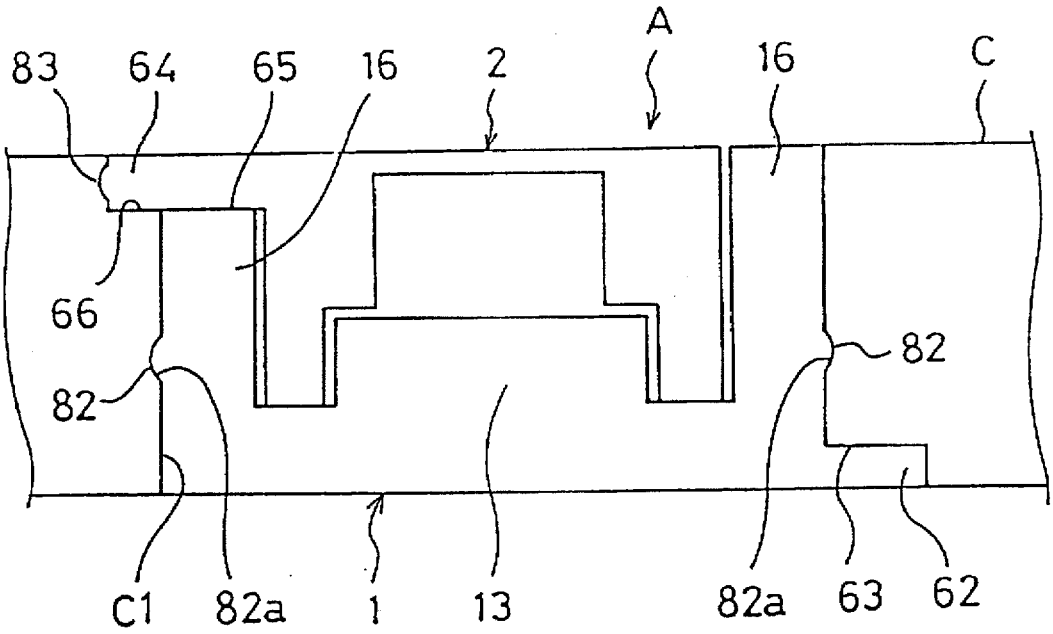
FIG. 30 is a partial front view showing the main portions of the card shown in FIG. 28.

As shown in FIGS. 27 and 29, the base member 1 has a shaft member 6 on each of side walls 16 on both sides in one end portion thereof. The shaft member 6 is fitted into a bearing recess 61 disposed in a rear end portion in the recessed portion C1 of the card C, so that one end portion of the base member 1 is pivotally supported by the card C. The axis of the shaft member 6 coincides with the axis center of the cover member 2 attached to the base member 1, i.e., the axis of a shaft 19. The attachment structure of the base member 1 and the cover member 2 is the same as that of the first embodiment. A first protruding piece 62 which protrudes sideways is disposed on the other end portion of the base member 1. As shown in FIGS. 29 and 30, a first engagement recess 63 corresponding to the first protruding piece 62 is formed in the recessed portion C1 of the card C. A second protruding piece 64 which protrudes sideways is disposed on the cover member 2, and an engagement recess 65 corresponding to the second protruding piece 64 is disposed on the side wall 16 of the base member 1. A second engagement recess 66 (see FIG. 30) is formed in the recessed portion C1 of the card C. The above-described first protruding piece 62 on the base member 1 and the corresponding first engagement recess 63 on the card C constitute the base member positioning mechanism disposed between the base member 1 and the card C. By the base member positioning mechanism, the base member 1 is allowed to rotate about the shaft member and be ejected to the back face side of the recessed portion C1, but is prevented from rotation and ejection to the surface side. The second protruding piece 64 on the cover member 2 and the second engagement recess 66 on the card C constitute the cover member positioning mechanism disposed between the cover member 2 and the card C. By the cover member positioning mechanism, the cover member 2 is allowed to rotate about the shaft member 6 (or the shaft 19) and be ejected to the surface side of the recessed portion C1, but is prevented from rotation and ejection to the back face side.

The cover member 2 and the base member 1 are linked by links 7, 7. Each of the links 7 has a circular hole 72 disposed in one end portion, and the circular hole 72 is pivotally supported by a shaft 71 which is protruded from the thick portion 23 of the cover member 2. A projection 73 disposed in the other end portion is movably fitted into and held by a guide groove 74 formed as a long hole in the side wall 16 of the base member 1. The guide groove 74 elongates in the longitudinal direction of the side wall 16. Herein, if the cover member 2 is in the open position, the projection 73 abuts against the edge portion of the guide groove 74, so as to restrict the open position of the cover member 2. Accordingly, the links 7, the projections 73, and the guide grooves 74 constitute the open position restricting mechanism.

The other constructions of the connector A are the same as those of the first embodiment described with reference to FIG. 1, etc. For example, that the base member 1 has a thin box shape, that the base member 1 is provided with the receiving face 12 of a V-shaped groove-like face and the terminal member 3, and that the cover member 2 has a function for preventing a plug from slipping out are the same as those described in the first embodiment. Accordingly, in the third embodiment, the condition in which the cover member 2 is opened and the plug 100 as the counter connector is connected corresponds to the condition shown in FIG. 13.

Next, the function will be described.

Figure 28:
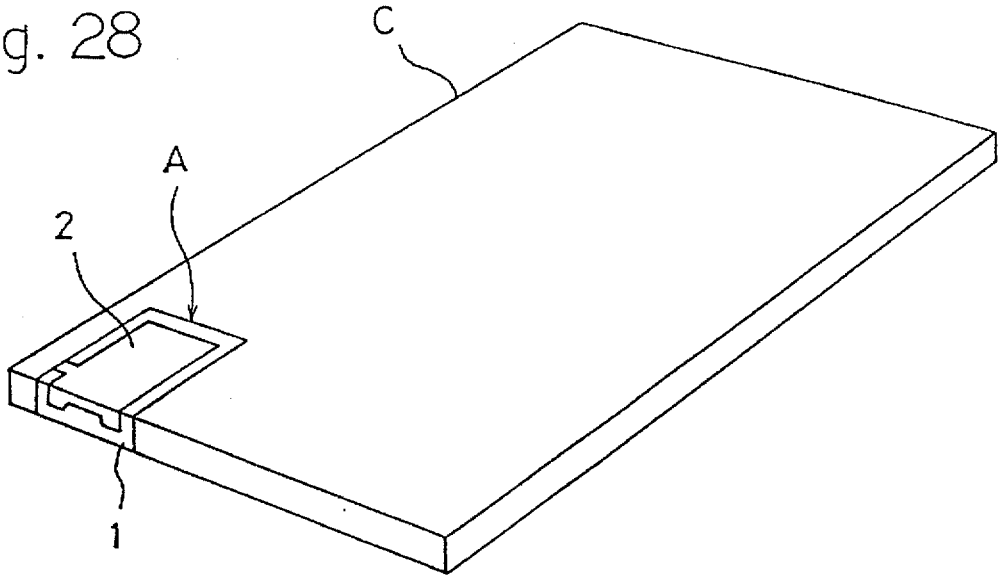
FIG. 28 is an external view showing a fourth embodiment of the electronic apparatus of a card type.

In the condition where the cover member 2 is closed, the upper face of the cover member 2 and the lower face of the base member 1 are flush with the surface and the back face of the card C, as shown in FIGS. 28 and 29. The connector A forms a portion of the card C.

Figure 32:
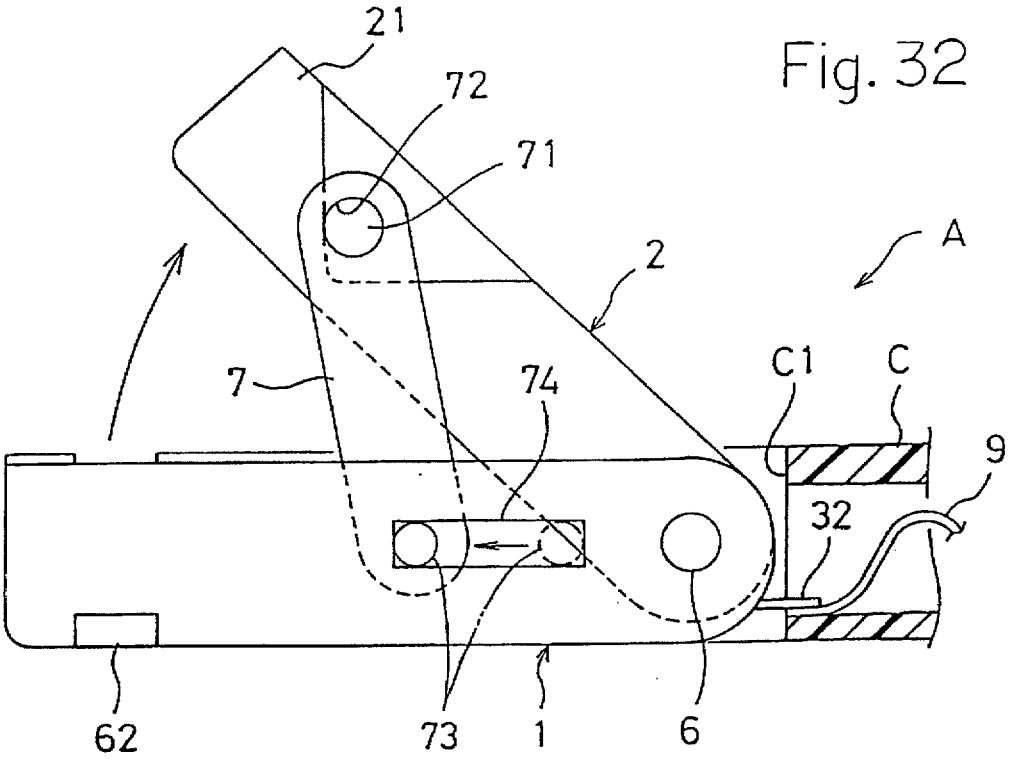
FIG. 32 is a side view of the connector assembled in the card shown in FIG. 28, in which a cover member is opened.
Figure 33:
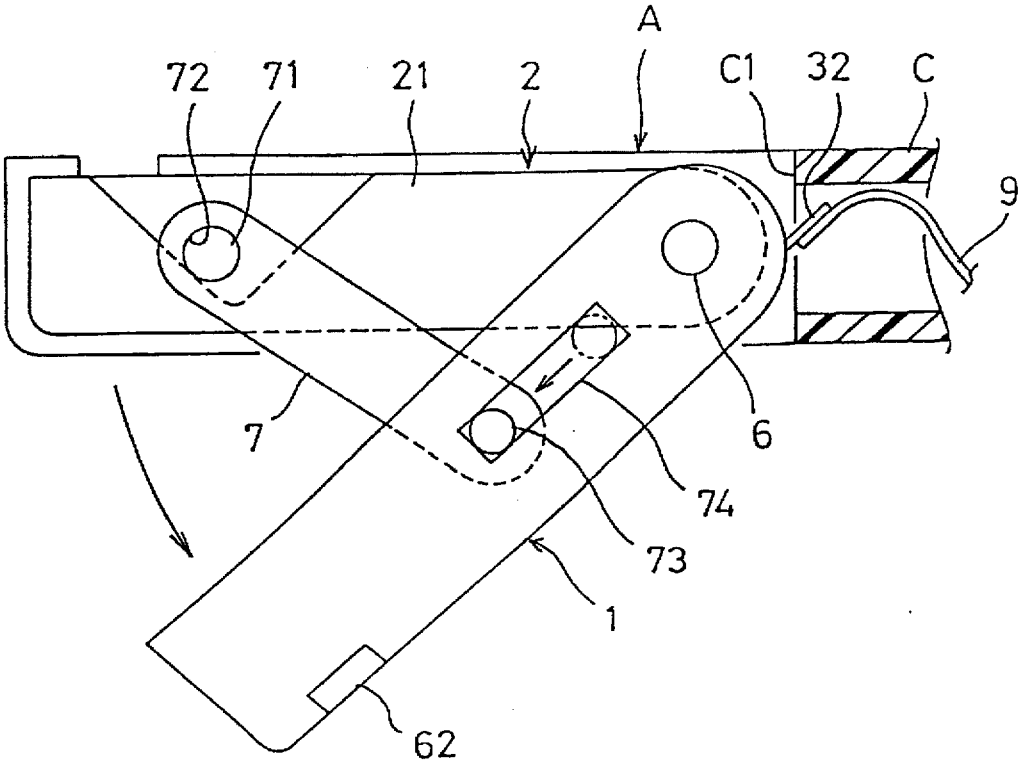
FIG. 33 is a side view of the connector assembled in the card shown in FIG. 28, in which a base member is opened.

When in use, in the case where the plug 100 is required to be inserted into the surface of the card C, the cover member 2 is opened as shown in FIG. 32. In this case, when the cover member 2 is pulled up, the second protruding piece 64 of the cover member 2 is extracted from the second engagement recess 66 of the card C, so that the cover member is opened without any problems. On the other hand, in the base member 1, the first protruding piece 62 is engaged with the first engagement recess 63 of the card C. Therefore, the base member 1 is prevented from being actracted from the surface side of the recessed portion C1 together with the cover member 2. In contrast, when the plug 100 is required to be inserted into the back face of the card C, the base member 1 protrudes from the back face of the card C as shown in FIG. 33. In this case, when the base member 1 is pulled down, the first protruding piece 62 of the base member 1 is extracted from the first engagement recess 63 of the card C, so that the base member is opened without any problems. On the other hand, in the cover member 2, the second protruding piece 64 is engaged with the second engagement recess 66 of the card C. Therefore, the cover member 2 is prevented from protruding from the back face of the recessed portion C1 together with the base member 1.

Figure 34:
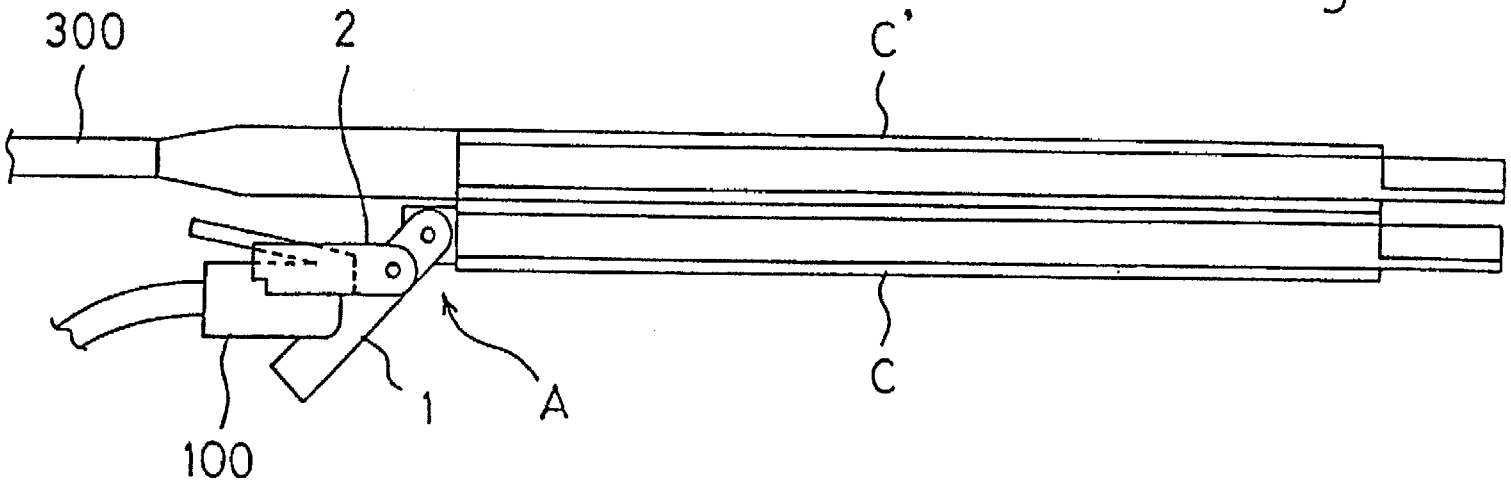
FIG. 34 is an explanatory view showing a use condition of the card in the fourth embodiment.
Figure 35:
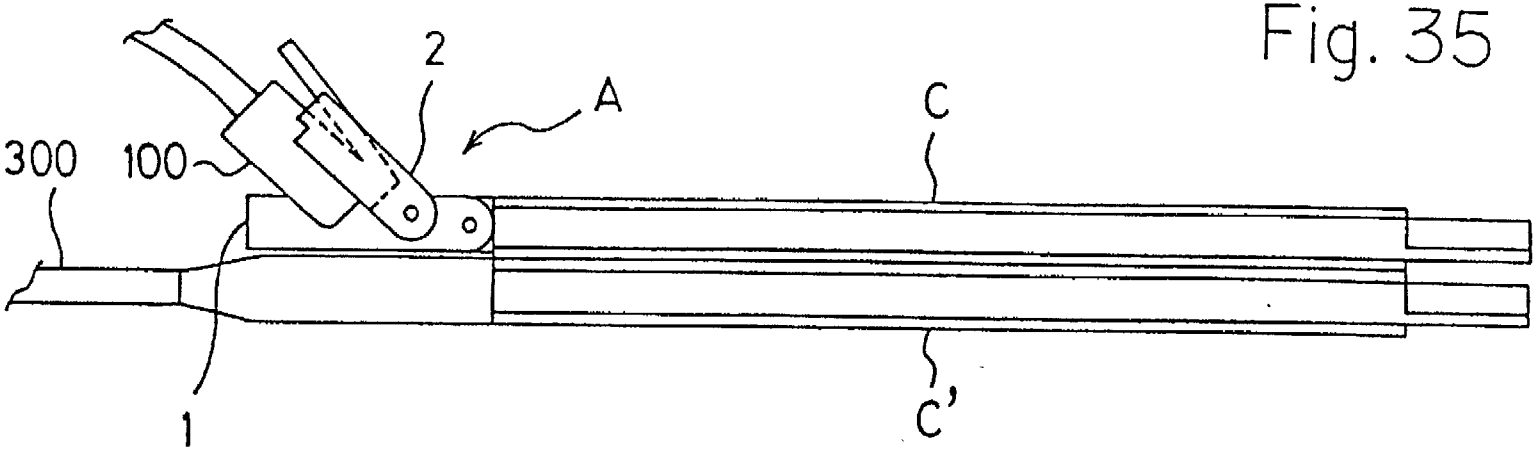
FIG. 35 is an explanatory view showing another use condition of the card in the fourth embodiment.

Accordingly, in the personal computer in which upper and lower slots are disposed, for example as shown in FIG. 34, if the card C' connected to the SCSI cable 300 is inserted into the upper slot, the base member 1 of the connector A of the card C inserted into the lower slot is pulled down and opened and the plug 100 is inserted into connector, with the result that the SCSI cable 300 cannot interfere with the insertion. Conversely, as shown in FIG. 85, if the card C' connected to the SCSI cable 300 is inserted into the lower slot, the cover member 2 of the connector A of the card C inserted into the upper slot is pulled up and opened so as to insert the plug 100 thereinto, and the cable 300 cannot interfere with the insertion.

The other functions are the same as those of the above-described embodiments. For example, that the cover member 2 prevents a human body from touching the terminal member 3 and prevents dust and dirt from attaching to the terminal member 3, that the links 7 restrict the open angle of the cover member 2, that the links 7 support and stabilize the plug 100 on both sides thereof when in use, and that the links 7 are useful for enhancing the coupling strength of the base member 1 with the cover member 2 when in use are the same as those described in the first embodiment.

Next, other preferred embodiments of the present invention will be described below.

Figure 11:
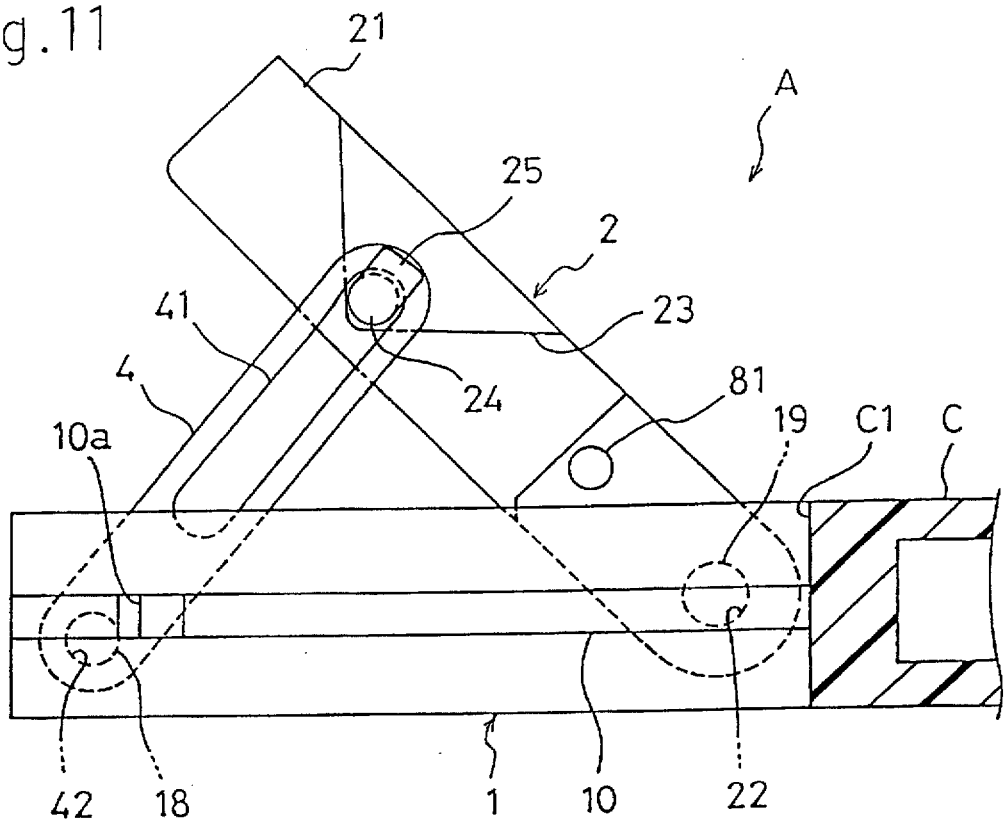
FIG. 11 is a side view showing a condition where the cover member of the connector assembled in the card shown in FIG. 2 or 3 is opened.

(1) As shown in FIGS. 3 to 5 showing the first embodiment of the connector A, FIGS. 9 to 11 showing the first and second embodiments of the electronic apparatus of a card type, and the like, a bulge portion 81 having a spherical face is disposed on a side face 21 of the cover member 2. When the cover member 2 is opened or closed, the bulge portion 81 passes over the link 4, so as to be ejected from or inserted into the long hole 41 of the link 4. As a result, the feel when the elongating portion 81 passes over the link 4 as the cover member 2 is opened or closed is transmitted to the hand, and this feel appears as a tactile feel when opening or closing the cover member 2. Thus, operability is enhanced.

(2) As shown in FIGS. 29 and 30 showing the second embodiment of the connector A and the fourth embodiment of the electronic apparatus of a card type, and the like, bulge portions 82, 82 each having a spherical face are disposed on the side walls 16, 16 of the base member 1, and corresponding recesses 82*a*, 82*a* are disposed on wall faces of the recessed portion C1 of the card C. In addition, a bulge portion 83 having a spherical face is disposed on the second protruding piece 64. With this construction, when the base member 1 is opened or closed with respect to the cover member 2, the bulge portions 82, 82 come out of or enter the recesses 82*a*, 82*a*. The shock at this time is transmitted to the hand as a tactile feel. When the cover member 2 is opened or closed with respect to the base member 1, the bulge portion 83 comes out of or enters the recess 83*a*, and the shock at this time is transmitted to the hand as a tactile feel. This appears as the tactile feel when opening or closing the base member 1 or the cover member 2. Thus, operability is enhanced.

(3) As for the connector A, instead of the links 4 in the first embodiment, the links 7 described in the second embodiment are used. In this case, it is necessary to provide a guide groove on the side wall 16 of the base member 1.

Figure 31:
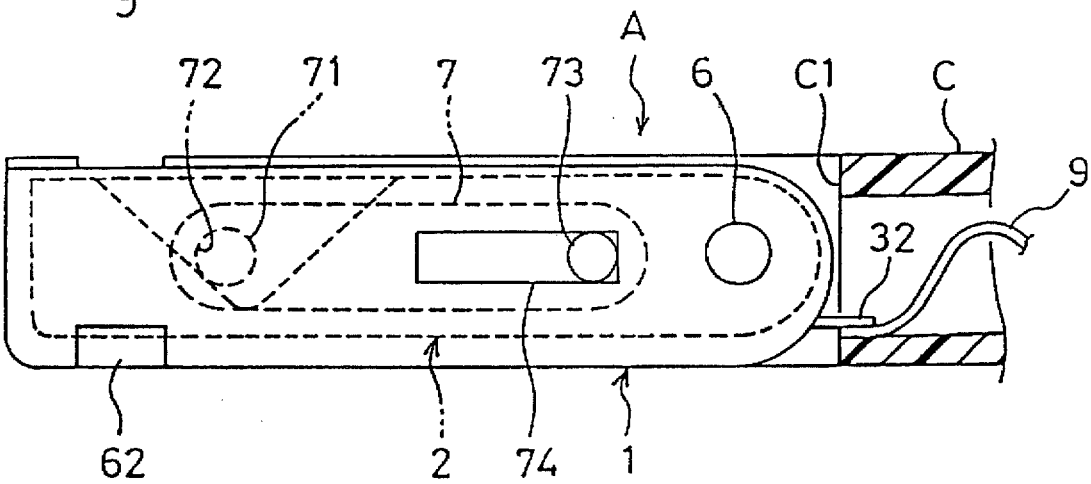
FIG. 31 is a side view of a connector assembled in the card shown in FIG. 28, in which a base member and a cover member are both closed.

(4) As shown in FIGS. 31 to 33 showing the fourth embodiment of the electronic apparatus of a card type, and the like, a flexible wiring board 9 is connected to the connection terminal 32, so that the opening and closing movement of the base member 1 is absorbed.

(5) As the counter connector, a connector having a rectangular parallelopiped shape is used instead of the modular plug 100 described with reference to FIG. 36.

What is claimed is:

1. An electrical connector, comprising: a base member having an upper face defining an aperture; a cover member for opening and closing said aperture of said base member; means defining a receiving face, disposed in said base member, for receiving a counter electrical connector having a rectangular parallelopiped shape; at least one terminal member, disposed in said base member, and being elastically in contact with a terminal of the counter electrical connector, said cover member being pivotally supported in one end portion of said base member for rotation between an opened position and a closed position, said cover member defining thereby an axis of rotation, said cover member and said receiving face of said base member forming an accommodating space for the counter electrical connector when said cover member is in its opened position, and said cover member and said receiving face sandwiching the counter electrical connector; an engagement mechanism engageable with an engagement portion of the counter electrical connector, thereby preventing the counter electrical connector from slipping out of said base member; and an open position restricting mechanism for restricting an open angle of said cover member with respect to said base member, said cover member defining a back face and said receiving face defining a supporting face which is substantially parallel to said back face of said cover member when said cover member is in its opened position.

2. An electrical connector according to claim 1, wherein each of said base member and said cover member is integratedly molded from electrically insulating synthetic resin.

3. An electrical connector according to claim 1, further comprising: a link having a long hole which extends in a longitudinal direction of the link, said link being rotatably attached to the other end portion of said base member, wherein said cover member includes a projection disposed on a side face of said cover member, said projection being movably fitted into and held by said long hole, said projection abutting against an edge portion of said long hole in the other end portion of said link when said cover member is in its opened position, thereby restricting the open position of said cover member, said link and said projection constituting said open position restricting mechanism.

4. An electrical connector according to claim 1, further comprising: a link having an end portion attached to said cover member for rotation about an axis which is parallel to the axis of rotation of said cover member, wherein said base member has a long guide groove disposed on one of its side walls which extends in the longitudinal direction of said side walls, and wherein said cover member includes a projection disposed in the other end portion of said link and movably fitted into and held by said long guide groove, said projection abutting against an edge portion of said guide groove when said cover member is in its opened position, thereby restricting the open position of said cover member, said link, said projection, and said guide groove constituting said open position restricting mechanism.

5. An electrical connector according to claim 1, further comprising the counter electrical connector, said counter electrical connector being embodied as a modular plug, comprising: a connector body having a rectangular parallelopiped shape; an elongated protruding portion extending across a front end corner portion of said connector body; an arm portion which has resiliency and extends from said protruding portion toward a back end portion of said connector body along said connector body; and stepped engagement portions disposed on both side faces of said arm portion.

6. An electrical connector according to claim 5, wherein, a retaining projection is disposed on a back face of said cover member so that, when said counter electrical connector is inserted in said accommodating space between said cover member in said opened position and said receiving face of said base member, said retaining projection is engaged with said engagement portion due to the recovering deformation of said arm portion which occurs after said engagement portion is pressed and said arm portion is deformed in a direction toward said connector body, said retaining projection constituting said engagement mechanism.

7. An electrical connector according to claim 5, wherein a recessed portion of said counter electrical connector having a width larger than a horizontal width of said protruding portion is disposed in an edge middle portion in said other end portion of said base member, and a protruding piece portion which protrudes at a position opposite to said recessed portion when said cover member is in its closed position is disposed on said cover member.

8. An electrical connector according to claim 7, wherein said receiving face is formed as a V-shaped groove-like face comprising a supporting face for supporting a lower face of said counter electrical connector and an abutting face for supporting a front face of said counter electrical connector, said supporting face being disposed in an end wall portion of said base member at a position partly secluded from the other end wall portion of said base member, said recessed portion being in contact with an end face of said end wall portion.

9. An electrical connector according to claim 1, wherein said base member further has an aperture accommodating said cover member in its closed position, and a cover member receiving portion which abuts against said cover member when it is in its closed position, thereby restricting the position of a surface of said cover member so that said surface is flush with an end face defined around said aperture of said base member.

10. An electrical connector according to claim 9, wherein said cover member includes an intermediate wall portion disposed inside each of both side walls of said base member, said cover member receiving portion is formed into a V shape in said intermediate wall portion, and wherein a triangular thick portion which abuts against said cover member receiving portion when said cover member is in its closed position is disposed in one portion of a side wall of said cover member.

11. An electrical connector according to claim 1, wherein said receiving face is formed as a V-shaped groove-like face comprising a supporting face for supporting a lower face of the counter electrical connector and an abutting face for supporting a front face of the counter electrical connector, said supporting face and said abutting face meeting at right angles.

12. An electrical connector according to claim 11, wherein said supporting face is disposed in an end wall portion of said base member at a position partly secluded from the other end wall portion of said base member.

13. An electrical connector according to claim 12, wherein said base member defines an inner space, and wherein said terminal member extends from one end wall portion to the other end wall portion in said inner space of said base member, said terminal member including a tip portion for insertion into a recess formed in one of said end wall portions and is engaged with an edge of said recess while maintaining resiliency of said terminal member.

14. An electrical connector according to claim 1, further comprising: a link having a long hole which extends in a longitudinal direction of the link, wherein said cover member includes a bulge portion having a spherical face disposed on a side wall of said cover member, said bulge portion passing over a link and disengages and enagages the long hole of said link when said cover member is opened or closed.

15. An electrical connector according to claim 1, wherein said cover member is povitally supported in one end portion of said base member for being relatively opened and closed relative to said base member.

16. An electronic apparatus using an electrical connector, in the form of a card, such as a modem card, said electronic apparatus comprising: said electrical connector according to claim 15; a recessed portion disposed in said card; and a recessed portion for pivotally supporting said base member.

17. An electronic apparatus using an electrical connector, in a form of an apparatus comprising a personal computer, said electronic apparatus comprising said electrical connector according to claim 15.

18. An electronic apparatus using an electrical connector, in the form of a card such as a modem card, said electronic apparatus comprising: a shaft member for pivotally supporting one end portion of said base member of said electrical connector according to claim 15 and a rear end portion of a recessed portion formed in said card, said shaft member being parallel to a rotation axis of said cover member; a base member positioning mechanism, disposed between said base member and said card, for allowing said base member to be rotated for ejection to one side of said recessed portion about said shaft member and for preventing said base member from being rotated for ejection to the other side; and a cover member positioning mechanism, disposed between said cover member and said card, for allowing said cover member to be rotated for ejection to said other side of said recessed portion about said shaft member and for preventing said cover member from being rotated for ejection to said one side.

19. An electronic apparatus using an electrical connector according to claim 18, wherein said base member includes a bulge portion having a spherical face disposed on a side face of said base member, a recess is correspondingly disposed on a side wall of said recessed portion of said card, said bulge portion having the spherical face being disposed to a second protruding piece disposed on said cover member, and a recess is correspondingly disposed on a side wall of said recessed portion of said card.

20. An electronic apparatus using an electrical connector, in the form of a card, such as a modem card, said electronic apparatus comprising: said electrical connector according to claim 1; and a recessed portion disposed in said card, said base member of said electrical connector being fixed in said recessed portion.

21. An electronic apparatus using a electrical connector according to claim 20, wherein the height of said base member is equal to the thickness of said card, and, when said base member is accommodated in and held by said recessed portion of said card, the other end portion of said base member is exposed on an end face of said card.

22. An electronic apparatus using an electrical connector, in a form of an apparatus comprising a personal computer, said electronic apparatus comprising said electrical connector according to claim 1.

23. An electronic apparatus using an electrical connector, in the form of a personal computer, said electronic apparatus comprising: said personal computer having a base unit in which a number of operation keys are arranged; a cover unit which has a display screen and is opened and closed with respect to said base unit; and said electrical connector according to claim 1 attached to said base unit.

24. An electronic apparatus using an electrical connector, in the form of a personal computer, said electronic apparatus comprising: said personal computer having a base unit in which a number of operation keys are arranged; a cover unit which has a display screen and is opened and closed with respect to said base unit; a recessed portion disposed in said cover unit; and said electrical connector according to claim 1, said base member of said electrical connector being fitted into and fixed to said recessed portion.

25. An electronic apparatus using an electrical connector, in a form of a card such as a modem card, said electronic apparatus comprising: said electrical connector according to claim 1; a recessed portion, formed in said card, for holding said base member of said electrical connector in a retractable manner in a depth direction; a spring member, interposed between said base member and said card, for urging said base member in a protruding portion from said recessed portion; a first engagement member which is disposed in one end portion of said base member and abuts against a protruding piece which protrudes in a direction across an entrance aperture of said recessed portion of said card when a pivotally supporting portion for said base member and said card member is protruded to the outside of said recessed portion, thereby preventing said base member from slipping out of said recessed portion; an opening spring member, interposed between said cover member and said base member, for urging said base member in an opening direction; a slide portion which is disposed in said cover member and slides due to a pressure by said protruding piece of said card for closing said cover member in a process in which said cover member is retracted into said recessed portion of said card together with said base member; a second engagement member which is disposed in said cover member and engaged with said protruding piece, thereby preventing said base member from protruding; and a space for allowing said cover member to be pressed into the inner space of said base member by a width which can release the engagement of said second engagement member with said protruding piece of said card.

26. An electronic apparatus using an electrical connector according to claim 25, wherein an elongated slide terminal integrated with said terminal member is led to the outside of one end portion of said base member, and said slide terminal is always elastically in contact with a conductive pattern disposed on said card.

* * * * *

UNITED STATES PATENT AND TRADEMARK OFFICE

CERTIFICATE OF CORRECTION

PATENT NO. : 5,679,013

DATED : October 21, 1997

INVENTOR(S) : Katsuya Matsunaga et al

It is certified that error appears in the above-indentified patent and that said Letters Patent is hereby corrected as shown below:

Claim 14, column 22, line 12, "enagages" should be --engages--.

Claim 21, column 22, line 60, "a" should be --an--.

Signed and Sealed this

Third Day of March, 1998

*Attest:*

*Attesting Officer*

BRUCE LEHMAN

*Commissioner of Patents and Trademarks*